US006685521B1

(12) United States Patent
Melius

(10) Patent No.: US 6,685,521 B1
(45) Date of Patent: Feb. 3, 2004

(54) HAND FIN APPARATUS

(76) Inventor: John Melius, 2725 Vista Ct., Waldorf, MD (US) 20603

( * ) Notice: Subject to any disclaimer, the term of this patent is extended or adjusted under 35 U.S.C. 154(b) by 0 days.

(21) Appl. No.: 10/274,877

(22) Filed: Oct. 22, 2002

Related U.S. Application Data

(60) Provisional application No. 60/330,469, filed on Oct. 23, 2001.

(51) Int. Cl.[7] ..... A63B 31/10
(52) U.S. Cl. ..... 441/56
(58) Field of Search ..... 441/56, 64; D21/239

(56) References Cited

U.S. PATENT DOCUMENTS 2,692,995 A * 11/1954 Bihan ..... 441/57
3,122,760 A * 3/1964 Glass, Jr. ..... 441/57
4,632,387 A * 12/1986 Guzman ..... 482/111
5,842,896 A * 12/1998 Liveoak ..... 441/56

* cited by examiner

*Primary Examiner*—Ed Swinehart

(57) ABSTRACT

Hand fins for swimmers include an aerodynamic cross-section that is shaped to generate hydrodynamic lift when water passes over it. Water flowing over a main body portion is guided toward a center of the hand fin to maximize performance. A handle portion is provided preferably via an opening in the main body portion. A wrist strap is attachable to the handle portion to help support a user's hand during use, thereby enhancing the power and control of the hand fin. The hand fin may be constructed of multiple materials with a rigid internal structure and a flexible outer surface, as an inflatable hand fin, and as hollow hand fin having an internal chamber. Some embodiments of the hand fin is designed to flex under water pressure during use, to produce larger lifting surfaces thus producing greater lift.

42 Claims, 15 Drawing Sheets

Fig. 3
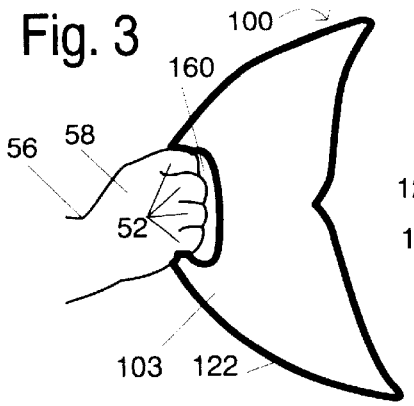
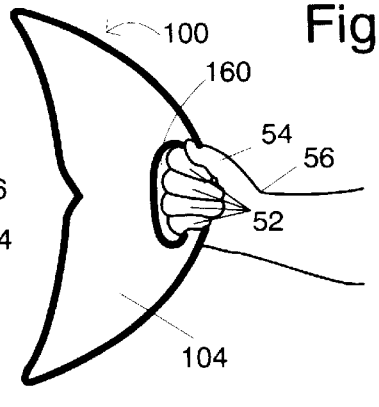
Fig. 4
Fig. 5
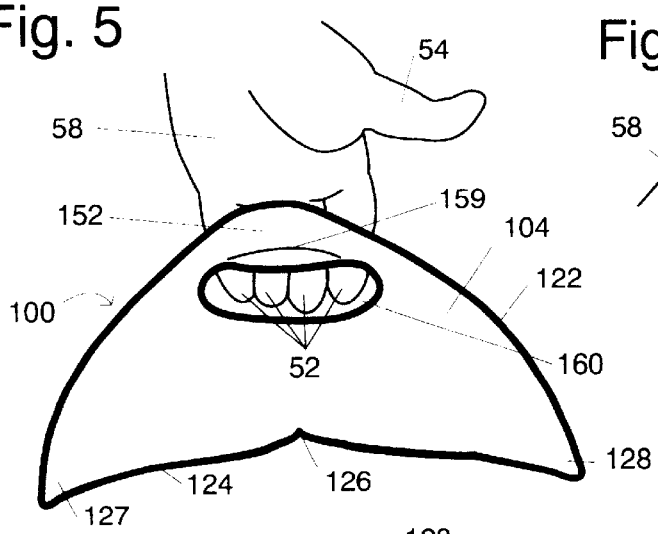
Fig. 6
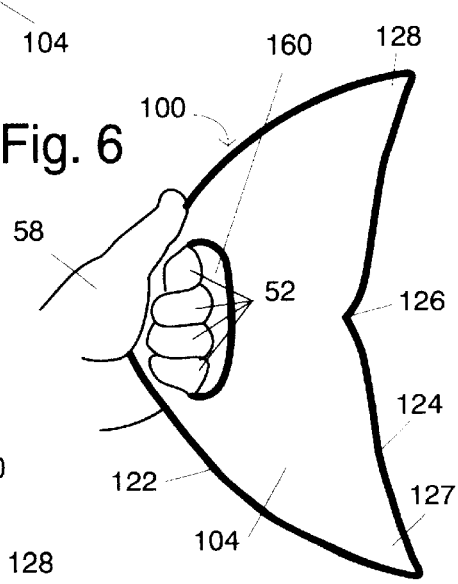
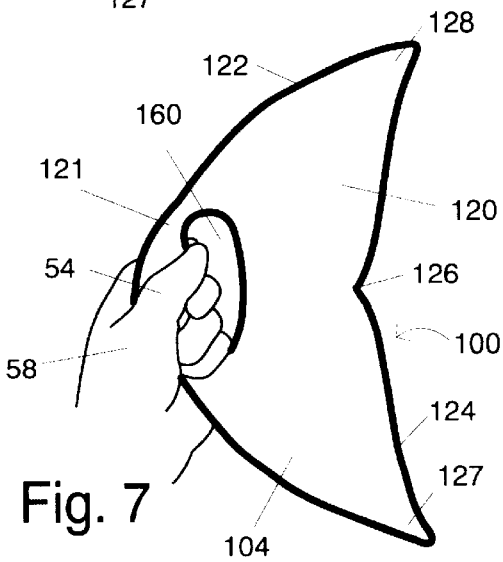
Fig. 7
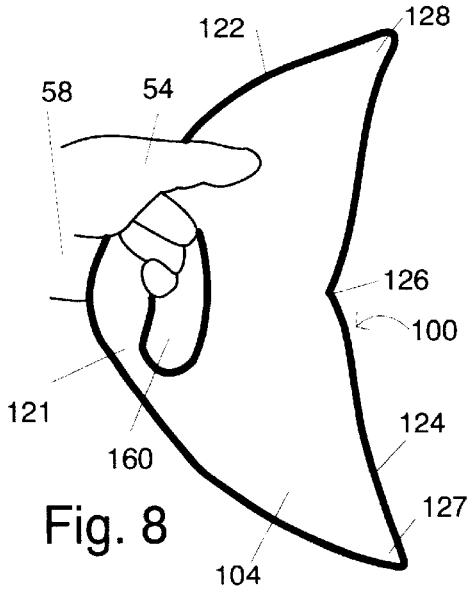
Fig. 8

Figure 9
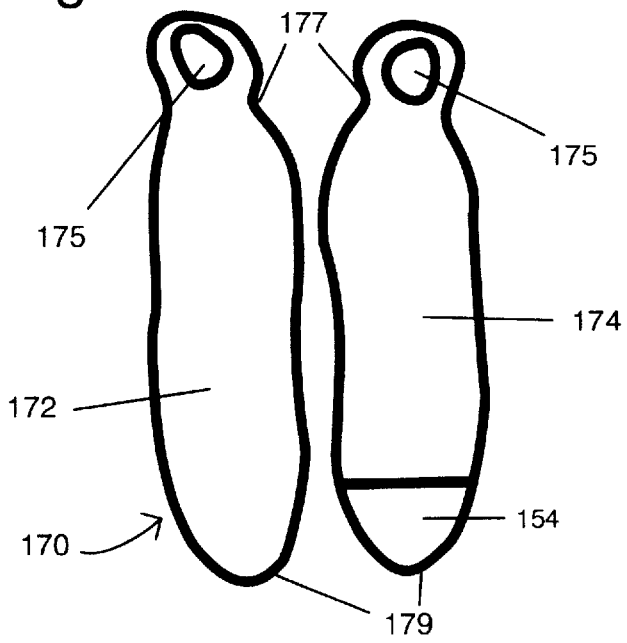
Figure 10
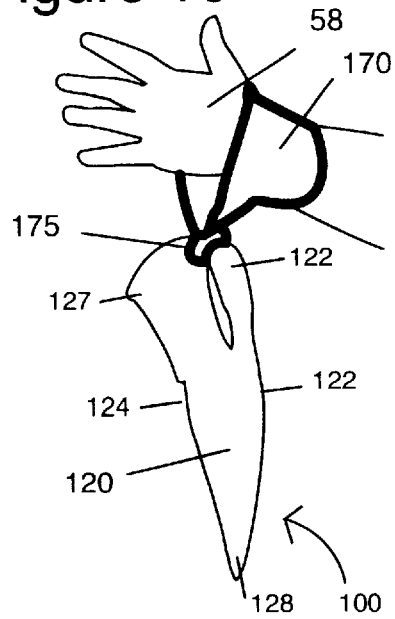
Figure 11
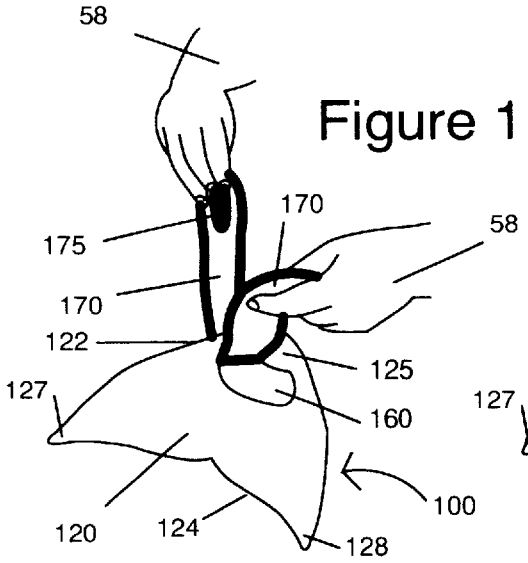
Figure 12
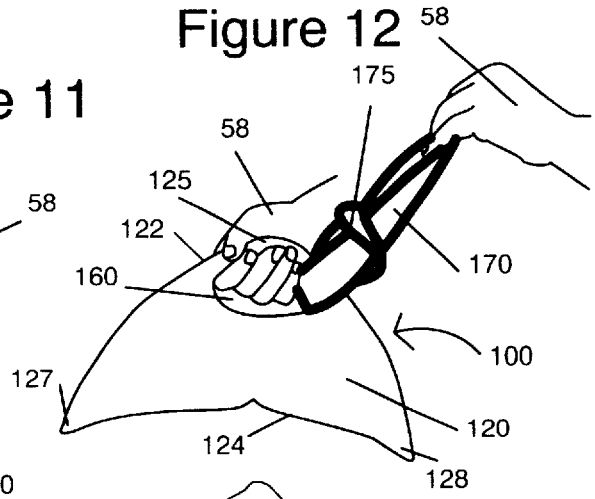
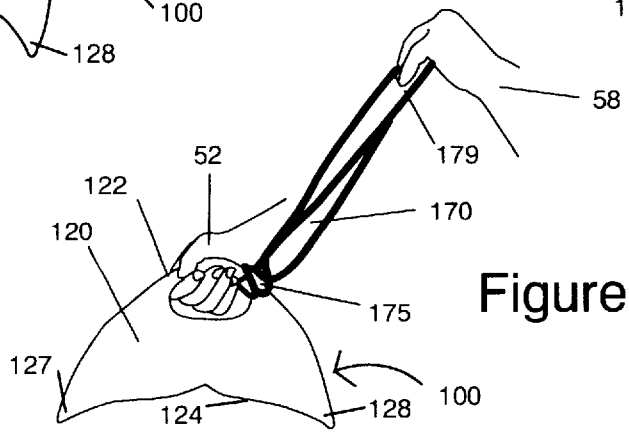
Figure 13

Figure 22
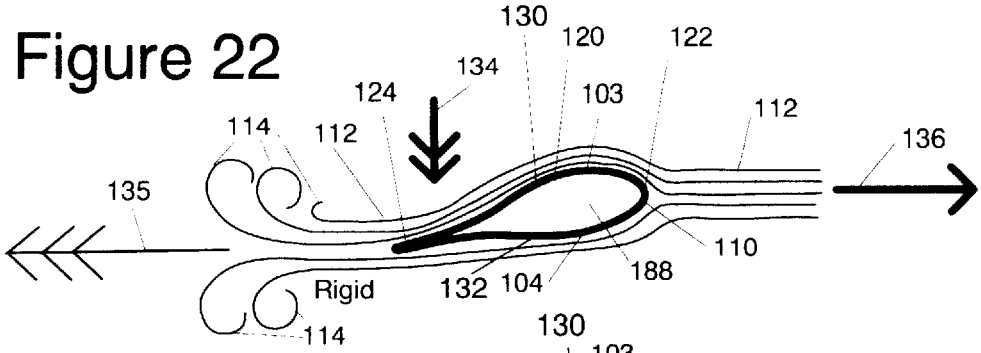
Figure 23
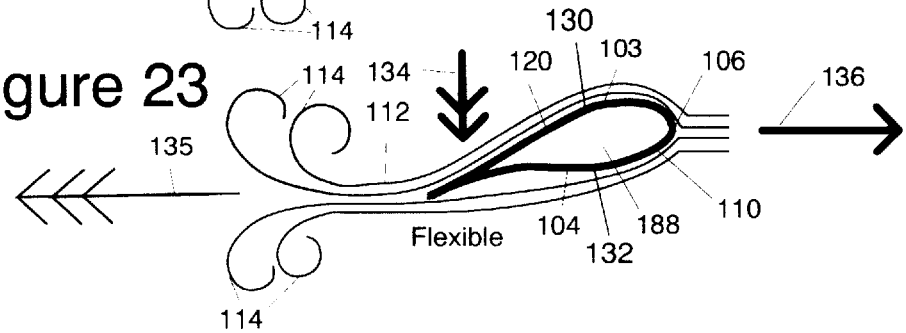
Figure 24
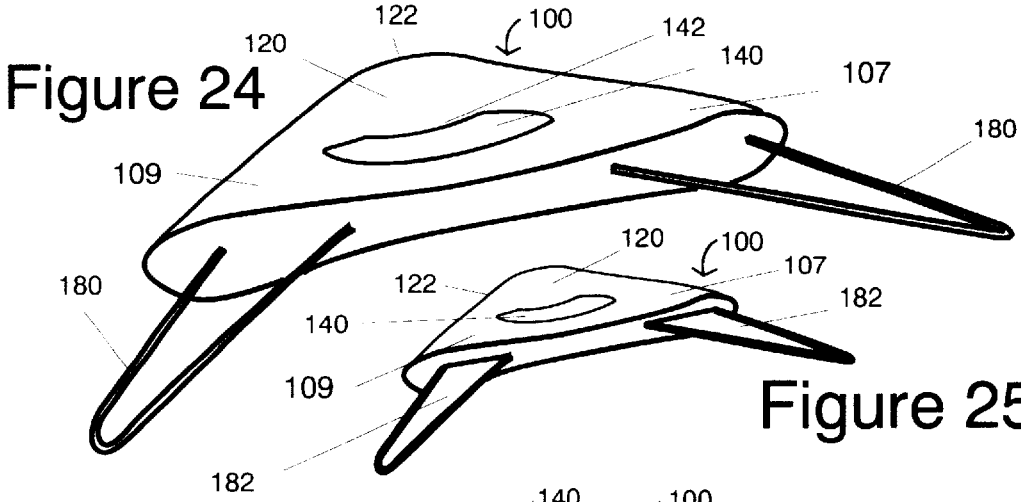
Figure 25
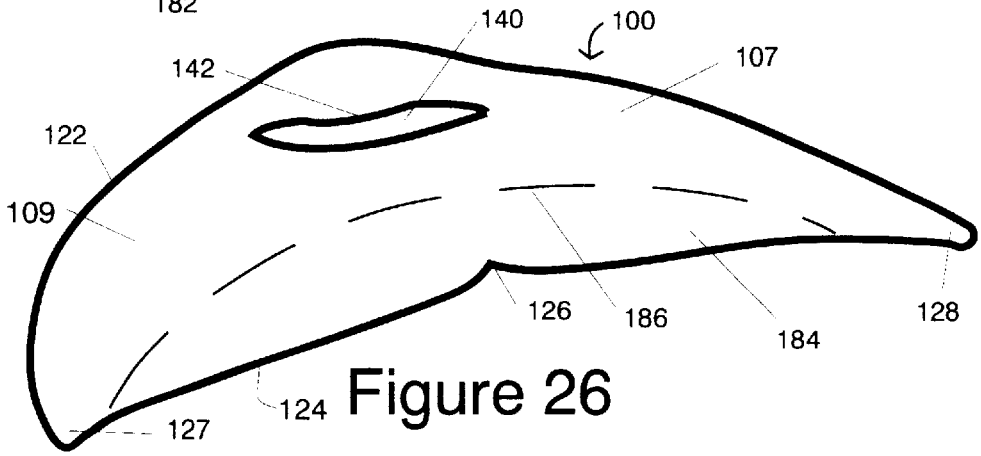
Figure 26

Figure 27
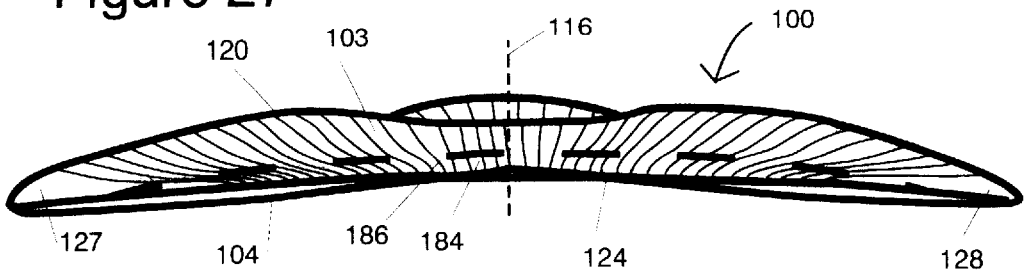
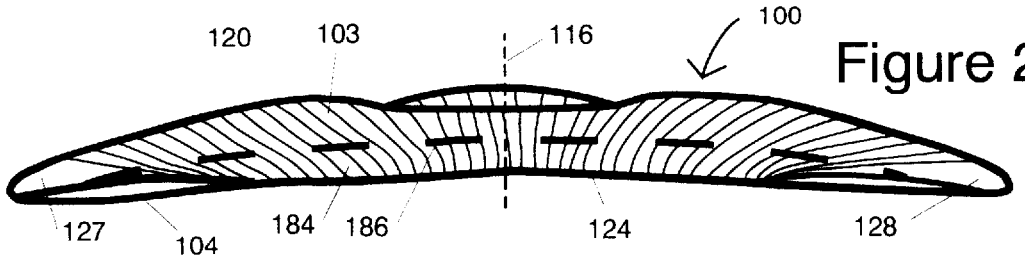
Figure 28
Figure 29
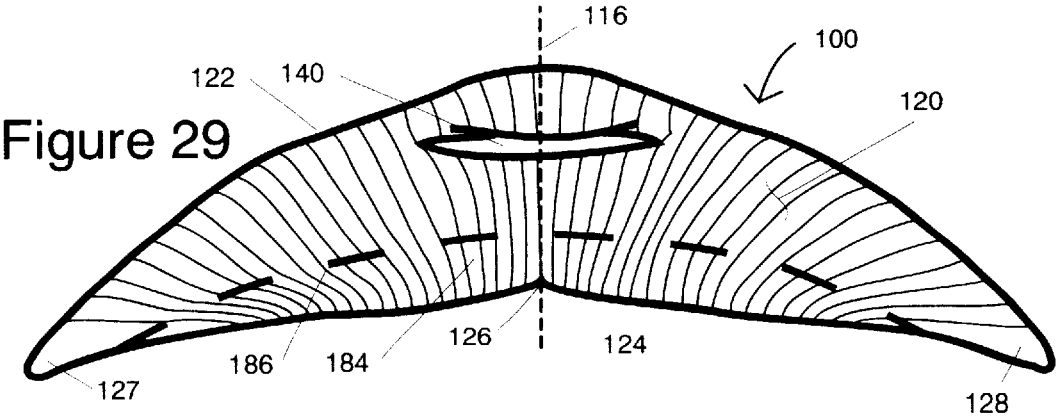
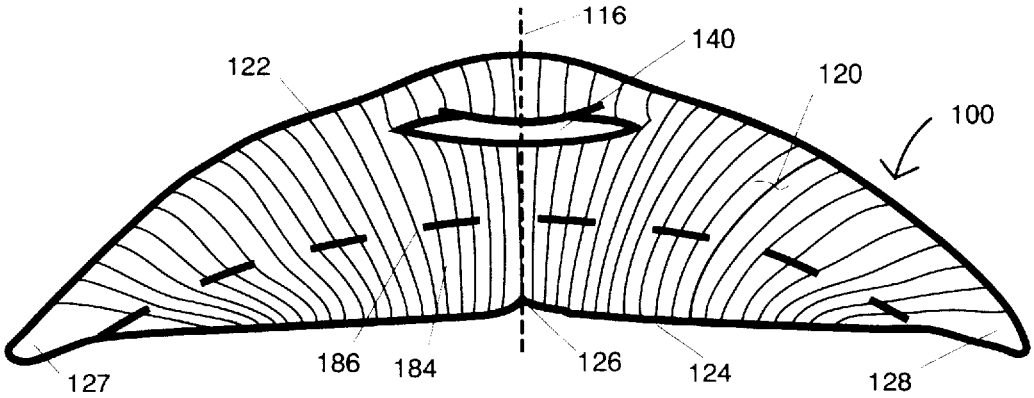
Figure 30

Figure 31
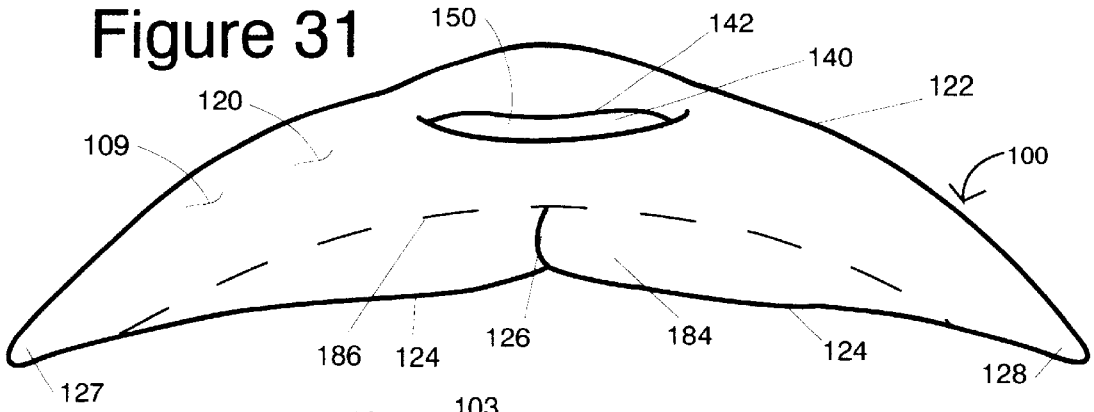
Figure 32
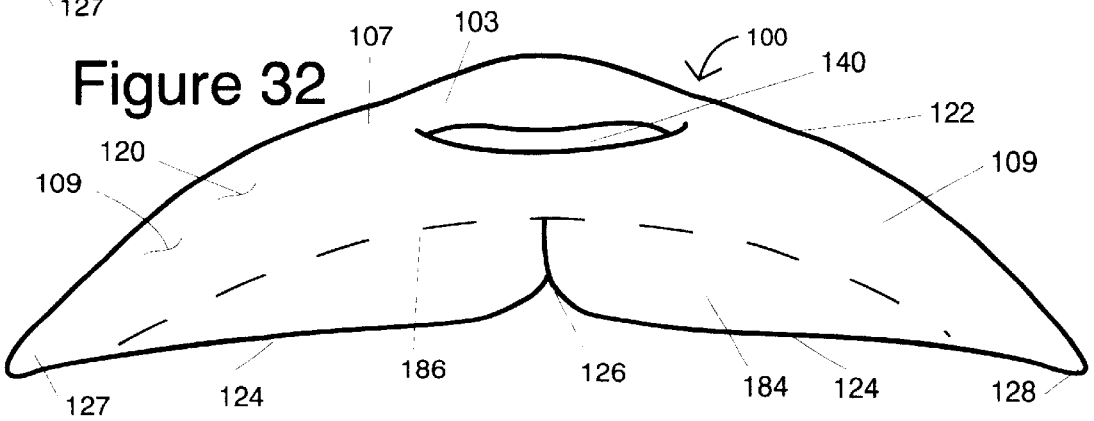
Figure 33
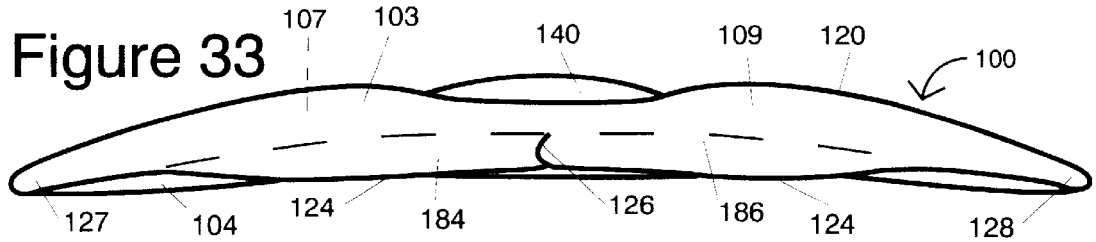
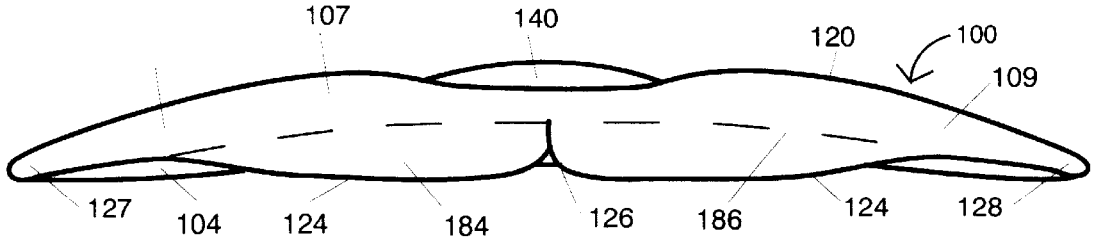
Figure 34

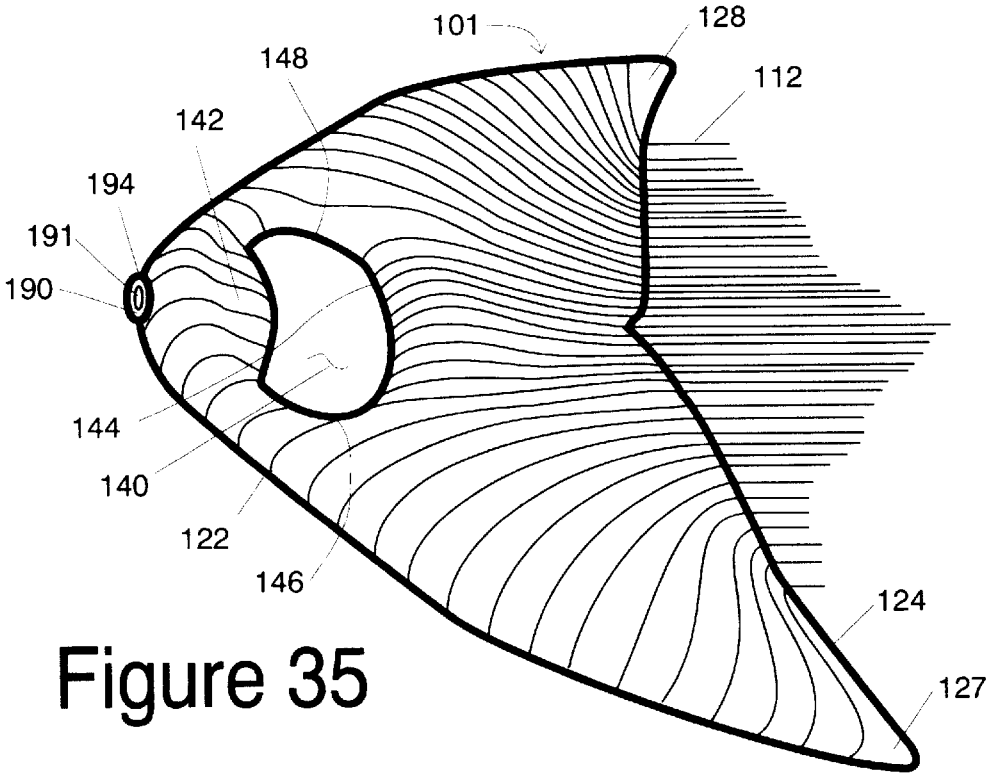
Figure 35
Figure 36
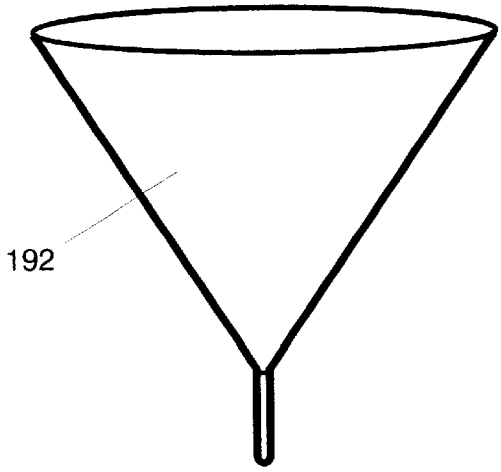
Figure 37
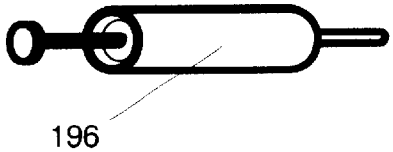

128
99
140
122
58
124
127
120

58
124
127
120
99
140
122

128
58
124
127
120
99
140
122

58
124
127
99
140
122

128
58
124
127
99
140
122
120

Figure 48
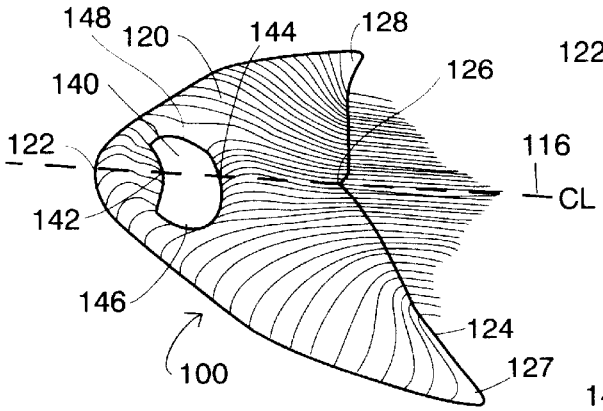
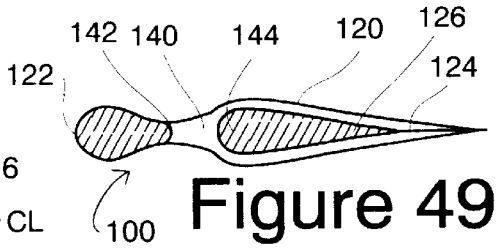
Figure 49
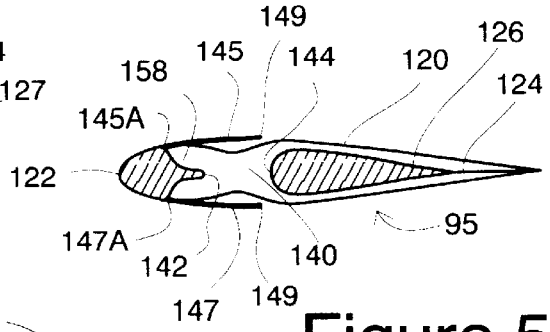
Figure 50
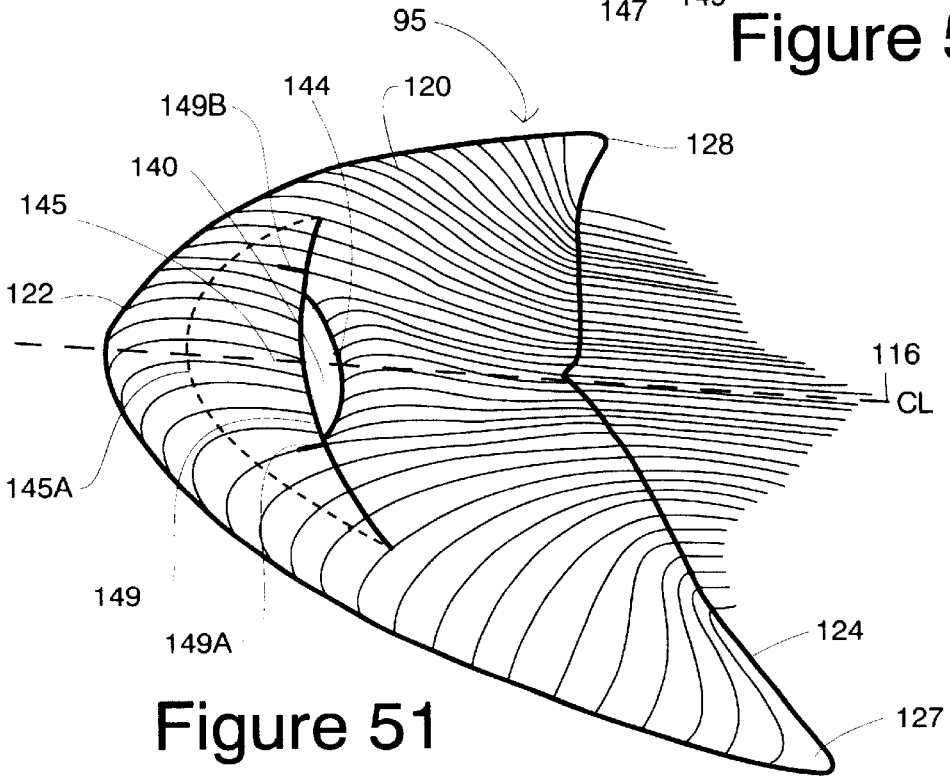
Figure 51

Figure 56
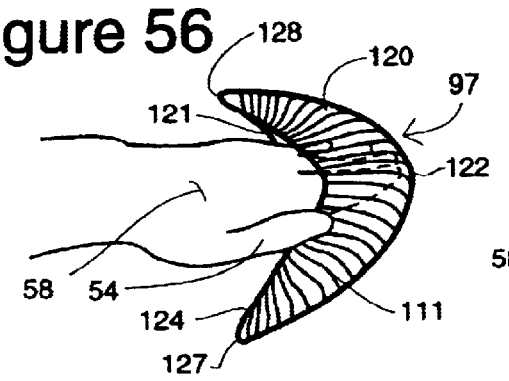
Figure 59
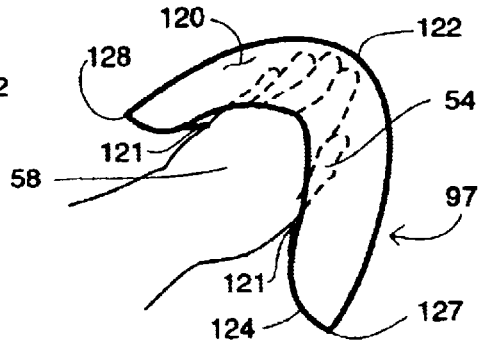
Figure 57
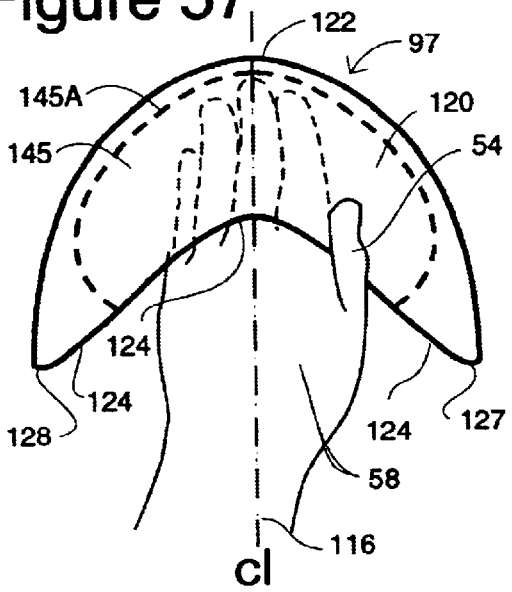
Figure 60
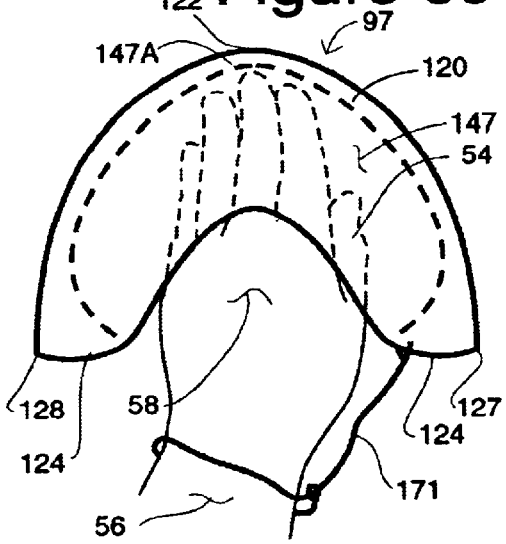
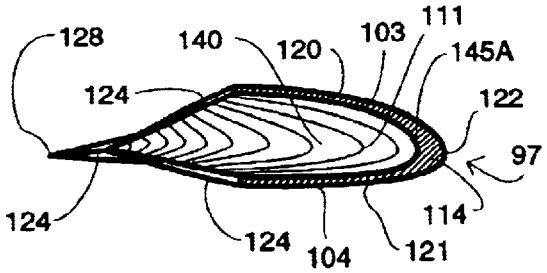
Figure 58

HAND FIN APPARATUS

CROSS REFERENCE TO RELATED APPLICATIONS

This patent application claims priority of Provisional Patent Application, Ser. No. 60/330,469, filed Oct. 23, 2001, and this provisional patent application is hereby incorporated by reference herein.

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

The present invention relates to a hand fin to aid in swimming, and more particularly to an aerodynamically shaped hand fin, formed by two air foils sharing an adjacent surface with both having a leading edge depending from the leading edge of the adjacent surface of the two air foils to a trailing edge, with the distal ends forming a tip joining the leading and trailing edges, and a hand interface.

The present invention adapts a combination of a fish's caudal fin (the tail fin) and a whale's fluke (the tail fin) propulsion systems into a useful structure that is ergonomically designed for use by human hands in swimming. This invention also discloses a wrist strap, a securing string, a glove, or a combination of both to aid in the use of hand fins for swimming. This invention also describes alternate embodiments of this hand fin that have additional advantages.

2. Background of the Invention

In the past, swimming under water with swim fins designed for the feet has made the use of the hands impractical, difficult, and inefficient. The problem with using the hands arises from the increased speed produced from using swim fins designed for the feet. At present, hands or hands wearing webbed gloves or hands wearing paddles function only as paddles in the water. The speed at which a person is swimming greatly influences the efficiency and possible use of a paddle. A similar example is seen when trying to use paddles with a boat that has a motor (the motor is similar to using foot fins). When the boat is not using the motor, the paddles can pull the boat through the water. When the boat is using a motor for propulsion, the paddles are useless.

Paddles are a form of "drag propulsion." This means they create a void in the water as they pull through the water. The water surrounding the paddle flows into the void and pulls the paddle (and person in the boat) in the direction of the void. If the motor powers the boat more quickly through the water, the paddles cannot create a void where the water moving into the void moves faster than the boat. The water flowing into the void is slower and provides no propulsion. If anything, the paddles would probably inhibit the flow of the boat through the water by causing drag. The same kind of situation arises with the use of the hands in swimming underwater while using swim fins on the feet. The hands cause more "drag" than any benefit generated from their use as a paddle. Thus, when swimming underwater with swim fins on the feet, the hands are almost never used.

This invention affects the ability of the hands to be used in swimming with swim fins on the feet. By using ergonomically designed "dual air foil tapering wing shaped" hand fins for use with human hands in swimming, propulsion can be produced by the "lift" that these "wing-shaped" hand fins create by moving them through the water at a correct angle of attack. One type of "dual air foil tapering wing shaped" fins are found in the symmetrical tail shape (fluke) used by dolphins and whales to produce extremely efficient and powerful thrust in water. The "lift" produced by a large whale using a tail fin is enough to propel a forty-five ton whale twenty feet above the water. Asymmetrical dual wing shapes are also found on many of the best swimming sharks and other fishes. This patent discloses both types of fin strategies for use with the hands in swimming.

This "lift" is the same type of force created by the wings of an airplane (these hand fins are also lifting forms). These hand fins are somewhat different than airplane wings in that they are curved to the center and rear of the form to produce a concentration of the flowing water into the center of the hand fin. This creates a water current that helps to give additional thrust to the hand fin and pulls water from the sides which decreases vortices and drag when these shapes are moved through the water. These hand fins, when moved horizontally in the water, "sail" across a body of water much as a glider sails through the air. This gliding motion is caused by "lift." A great advantage of using lift is that lift increases with the speed of the flowing water.

Even though the forces of lift are increased with an increase in the speed of water flowing over the surface, the effort needed to create a proper angle of attack and movement through water is the same or decreases. This makes this hand fin invention exceptionally useful for swimming with hand swimming fins for the feet because they increase the speed that the swimmer moves through the water. These hand fins use this increased water speed to give additional lift and propulsion to the swimmer with little or no effort required to achieve this increased propulsion. There are a number of articles dealing with the science of this issue that have issued within the last few years. Many of the articles written by Professor Walker at the University of Southern Maine deal with the efficiencies of rowing (the use of paddles for propulsion) versus "flapping" (the use of airfoils for propulsion) in water. In these articles, the conclusion was that the proper use of airfoils was always more efficient than using paddles at every speed and at all normal Reynolds numbers (RE). The most relevant sites on the web are listed below: http://www.usm.maine.edu/~walker/pdfs/SICB2002ms.pdf (Rowing and Flapping at Low Re—Jeffrey A. Walker—American Zoologist, in press) http://www.usm.maine.edu/~walker/pdfs/JEB2002.pdf [The Journal of Experimental Biology 205, 177–187 (2002)-Printed in Great Britain© The Company of Biologists Limited 2002-JEB3576] http://www.usm.maine.edu/~walker/pdfs/ProcRoySocB2000.pdf (Mechanical performance of aquatic rowing and flying—Jeffrey A. Walker* and Mark W. Westneat—Royal Society—doi 10.1098/rspb.2000.1224) http://mshades.free.fr/flapping/flapping.html (The image describes the OPTIMAL FLAPPING WING CYCLE (with best propulsive efficiency), and below, the cycle of a caudal (movement of a dolphin flipper),) http://mshades.free.fr/flapping/flipper.html (bionic analysis: MOVEMENT OF A DOLPHIN FLIPPER→PROPULSIVE HYDROFOIL)

U.S. Pat. No. 6,375,531 teaches the principle of using a lifting "tail fin" from a foot fin for swimming with the hand.

Although many of the principles are the same, the U.S. Pat. No. 6,375,531 does not teach an ergonomic hand interface for the swimmer. Not having an ergonomic interface for the hand of the swimmer causes numerous problems. This patent reveals the use of ergonomic hand interfaces.

BRIEF SUMMARY OF THE INVENTION

An example of this principle is seen everyday on airplanes. The motor and propeller can move a structure through the air, but the lifting forms designed into the wings increase the efficiency, speed, and control of the flying structure much as these hand fins help swimmers.

A secondary advantage of using these hand fins arises from the increased ability of the swimmer to change direction easily and have more control while swimming. Because these hand fins aid in propulsion, they can be used to help alter direction without losing speed or increasing effort. By simply aiming them in the desired direction and using them normally, the swimmer is propelled in the new direction without a loss of speed or increase in effort. These hand fins can also be used as rudders for steering. They make swimming a more aquatic experience for the swimmer because he is able to use all of his limbs while swimming and control his direction of swimming with great ease.

When swimming in natural bodies of water, situations occur where turning around is difficult or impossible. These fins can be held in front of the swimmer and can be used to propel the swimmer backwards away from possible danger or undesirable creatures without requiring the swimmer to turn around. Another advantage of being able to swim backwards is that one can move away from danger while continuing to monitor the cause of the danger by facing it.

In an exemplary embodiment of the invention, a hand-held hand fin apparatus includes a leading edge having a first thickness, a trailing edge having a second thickness, narrower than the first thickness, and a main body portion extending between the leading edge and the trailing edge. The main body portion is shaped such that water flowing over the main body portion is guided toward a center of the swimming fin. Preferably, the leading edge, trailing edge and main body portion define a fishtail-shaped hand swimming fin, wherein a cross-section of the fishtail-shaped hand swimming fin is aerodynamically shaped to generate lift.

The hand swimming fin may further include a handle portion that is shaped to be grasped by a human hand. In one arrangement, the handle portion is defined by an opening in the main body of the hand fin apparatus. A handle pad is selectively attachable to the handle portion for adjusting a grip size of the handle.

The main body portion preferably has a third thickness that is larger than the first thickness, and tapers towards the trailing edge direction. A focusing raceway may be formed along the center of the symmetrical hand fin apparatus. The focusing raceway extends between the main body portion and the trailing wedge portion, tapering in thickness toward the center of the hand fin apparatus. The leading edge and trailing edge join at two trailing points at opposite distal ends of the hand fin apparatus.

The hand swimming fin may also include a strap attachable to the handle portion of the hand fin apparatus. The strap may include a means for releasably securing the strap to the hand fin apparatus, and for securing a user's hand to the hand swimming fin. In one arrangement, the hand fin apparatus is inflatable. In an alternate embodiment, the hand fin apparatus is hollow, with a chamber located within the hand fin apparatus. The hand fin apparatus may also be of solid construction, with different material used to provide a flexible tail fin portion.

Preferably, the hand fin apparatus is substantially symmetrical from top to bottom, and side to side. The hand fin apparatus includes a main body having an aerodynamic-shaped cross-section, with a leading edge and a trailing edge. A contour of the main body is shaped such that water flowing over the main body is guided toward a center of the hand fin apparatus. The hand fin also includes a handle portion that is shaped to be grasped by a human hand.

In yet another exemplary embodiment of the invention, the hand fin apparatus may be manufactured with a leading edge material; a main body portion secured to the leading edge material, the main body portion less rigid than the leading edge material; and a flexible trailing edge material secured to the main body portion. The flexible trailing edge material is less rigid than the main body portion.

Other objects and advantages of the present invention will be more readily apparent from the following detailed description when read in conjunction with the accompanying drawings.

BRIEF DESCRIPTION OF SEVERAL VIEWS OF THE DRAWINGS

FIG. 3 shows a first side of the hand fin apparatus, when grasped about the handle, by the hand of a user.

FIG. 4 shows the second side of the hand fin apparatus shown in FIG. 3, showing the user's fingers extending through the handle portion.

FIG. 5 shows an alternate position of the user's hand, with fingers extending through the handle portion with the thumb extended.

FIG. 6 shows the handle portion of the hand fin apparatus, with the user's fingers extending through the handle portion, and the thumb positioned to extend along the leading edge of the aerodynamically shaped hand fin.

FIG. 7 shows an alternate grasping position of the handle portion of the hand fin apparatus, where the user's hand is positioned to one side below the centerline of the hand fin apparatus.

FIG. 8 shows another alternate grasping position of the handle portion of the hand fin apparatus, wherein the user's hand is positioned above the centerline of the hand fin apparatus.

FIG. 9 is a detail view showing first and second sides of a wrist strap having an aperture positioned at a first end, and extending to a distal end of the wrist strap.

FIG. 10 shows the wrist strap releasably secured to the handle portion of the hand fin apparatus, with the wrist strap further extending about a user's wrist, in preparation for use.

FIG. 11 is a detail perspective view of the wrist strap positioned through the handle portion of the hand fin apparatus.

FIG. 12 is a detail perspective view of the wrist strap of FIG. 11, showing the distal end of the wrist strap extending through the aperture in the aperture end of the wrist strap.

FIG. 13 is a detail perspective view of the wrist strap shown in FIG. 11, wherein the distal end of the wrist strap is pulled to cinch the wrist strap about the handle portion of the hand fin apparatus.

FIG. 22 is a cross sectional view of the hand fin apparatus showing water flow extending above and below the aerodynamic hand fin apparatus, with water flowing over its lifting surface and rigid flat surface at a proper angle of attack.

FIG. 23 is a cross sectional view of the hand fin apparatus showing an alternate water flow, with a flexible trailing end, as the hand fin apparatus is moved through the water.

FIG. 24 is an exploded perspective view of the hand fin apparatus, showing multiple materials used to fabricate the hand fin apparatus.

FIG. 25 is an alternate perspective view of the hand fin apparatus, showing alternate multiple materials used to fabricate the hand fin apparatus.

FIG. 26 is a perspective view of the hand fin apparatus assembled for use.

FIG. 27 is a perspective view of the hand fin apparatus shown in FIG. 1, showing the position of the flexible trailing edge in dashed line.

FIG. 28 is an alternate end view of the hand fin apparatus shown in FIG. 27, showing the flexible trailing edge of the hand fin apparatus in dashed line, with the flexible trailing edge flexing during use.

FIG. 29 is a top perspective view of the hand fin apparatus shown in FIG. 27, with the flexible trailing edge of the hand fin apparatus shown in dashed line.

FIG. 30 is a top perspective view of the hand fin apparatus shown in FIG. 28, with the flexible trailing edge flexing during use.

FIG. 31 is a top view of the hand fin apparatus, showing the flexible trailing edge overlapping at the centerline of the hand fin apparatus to form a focusing raceway to direct water flow across the center of the hand fin apparatus.

FIG. 32 is an alternate top view of the hand fin apparatus shown in FIG. 31, showing the flexible trailing edge flexing to increase area during use.

FIG. 33 is a trailing end perspective view of the hand fin apparatus shown in FIG. 31.

FIG. 34 is a trailing end perspective view of the hand fin apparatus shown in FIG. 32, showing the flexible trailing edge flexing during use.

FIG. 35 shows a perspective view of an inflatable hand fin apparatus with an air valve positioned in proximity to the handle portion of the hand fin apparatus.

FIG. 36 shows a collapsible funnel that can be used toad a liquid into the inflation device.

FIG. 37 shows an inflation syringe used to inflate the hand fin apparatus with liquid or with air.

FIG. 48 is a side view perspective drawing of the hand fin apparatus, showing the flexible trailing edge at the centerline of the hand fin apparatus to form a focusing raceway to direct water flow across the center of the hand fin apparatus.

FIG. 49 is a cross-section drawing of a hand fin apparatus taken along the centerline of FIG. 48. The handle and center of the hand fin are solid and are represented with a diagonal hatched pattern.

FIG. 50 is a cross-section drawing referencing the centerline of the hand fin in FIG. 51. Again, the solid sections are hatched and a flap extends over the open area of the handle.

FIG. 51 is a side view perspective drawing of an alternative hand fin apparatus, showing the flexible trailing edge at the centerline of the hand fin apparatus to form a focusing raceway to direct water flow across the center of the hand fin apparatus. There is a flexible flap covering most of the hole for the handle.

FIG. 56 is a side perspective view of a hand fin with the handle interface opening along the trailing edge. The topographical lines running from the leading edge to the trailing edge show the natural flow lines of water over the surface of the hand fin.

FIG. 57 shows a top view of the hand fin in FIG. 56 with the dashed line showing the solid elements of the hand fin with a user's hand positioned within the handle interface.

FIG. 58 is a cross section of the hand fin in FIG. 57 taken along the centerline of the hand fin with the hatching shown in the solid areas.

FIG. 59 is a side perspective view of a hand fin with the handle interface opening along the trailing edge and the hand is shown with an alternative grip.

FIG. 60 shows a top view of the hand fin in FIG. 59 with a user's hand positioned within the handle interface and a securing string connecting the hand fin to the user's wrist.

DETAILED DESCRIPTION OF THE INVENTION

Figure 1:
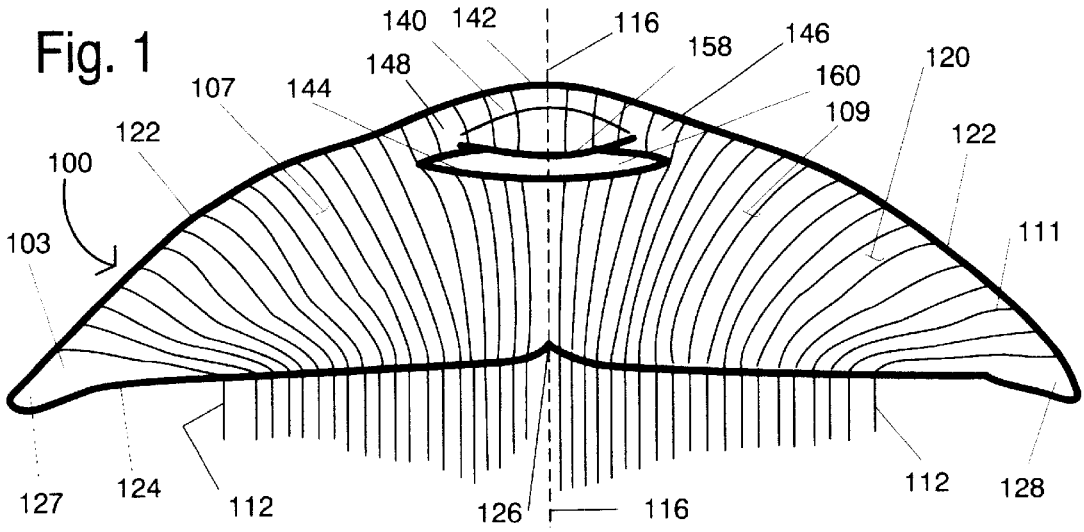
FIG. 1 is a perspective drawing viewed from the trailing edge of the hand fin apparatus, with topographical lines shown to illustrate water flowing over the outer surface of the hand fin.

FIG. 1 is a top view of the hand fin apparatus 100, with a plurality of topographical lines 111, showing how water 112 flows over the outer surface 120 of the hand fin apparatus 100. The water 112 passes over the leading edge 122 to the trailing edge 124 of the hand fin apparatus 100. The aerodynamic shape 110 of the hand fin apparatus 100 serves to concentrate the flow of water 112 towards the centerline 116 of the hand fin apparatus 100. Water 112 flows towards the centerline 116 of the hand fin apparatus 100 because the lifting surface 130 curves back from the front 106 towards the back 108 of the hand fin apparatus 100 and towards the centerline 116. Since water follows the path of least resistance, it flows to concentrate towards the centerline of the hand fin apparatus. The thickest part of the hand fin apparatus 100 is located approximately one-third of the distance from the leading edge 122 of the hand fin apparatus 100 to the trailing edge 124.

A handle portion 140 is located between the leading edge 122 and the trailing edge 124 of the hand fin apparatus 100. The handle portion 140 is preferably located in proximity to the centerline 116 of the hand fin apparatus 100 and near the aerodynamic shape optimum pivot point (sees accompanying paper on OPTIMAL FLAPPING WING CYCLE). The handle portion 140 is sized to receive the fingers 52 of a user 50 selectively therethrough, therein, or thereon and to provide a grasping surface to manipulate the hand fin apparatus 100 in water 112. The handle portion 140 may be grasped in alternate ways, as shown in FIG. 2 through FIG. 9, in FIG. 38 through FIG. 46A, FIGS. 56–57, and FIGS. 58–59 which accompany this specification. These alternate grasping positions are for illustrative purposes only, as one of average skill in this art may adapt alternate ways to grasp the hand find apparatus 100 disclosed herein, and such alternate grasping positions are intended to be incorporated within the scope of this disclosure, and the following claims.

The handle portion 140 includes a leading handle edge 142, a trailing handle edge 144, a first handle side 146 and a second handle side 148. The handle portion 140 preferably passes entirely through the hand fin apparatus 100, enabling the user 50 to pass their fingers 52 entirely through the handle portion 140. Alternately, the handle portion 140 may be formed as a handle recess 150 on first and second (top and bottom) sides 103, 104 of the hand fin apparatus 100.

The leading-handle edge 142 of the handle portion 140 is larger in thickness than the trailing handle edge 144, to provide a focusing raceway 126 for the passage of water 112 therethrough. With the decrease in the size, and the absence of material in the focusing raceway 126, water 112 flows naturally towards the centerline 116 of the hand fin apparatus 100. The absence of material in the focusing raceway 126 creates a path of least resistance for the water 112 to flow therethrough.

When the hand fin apparatus 100 is properly angled to the stream of water 112, it creates a lifting surface 130 and a pressure surface 132 (as seen in FIGS. 22 and 23). The hand fin apparatus 100 is preferably substantially symmetrical from side to side 107, 109 and front to back 106, 108 and top to bottom 103, 104. Thus, the lifting surface 130 is determined by the angle of attack of the hand fin apparatus to the flow of water 112. Either the top side 103 or the bottom side 104 of the hand fin apparatus 100 can be a lifting surface 130 or a pressure surface 132, depending upon the apparatus and its angle of attack (pitch) to the flow of the water over its surfaces.

Figure 18:
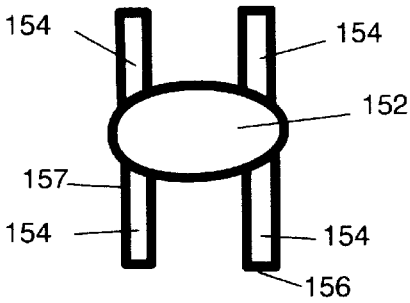
FIG. 18 is a top view of a handle pad sized for securement about the handle portion of the hand fin apparatus.
Figure 19:
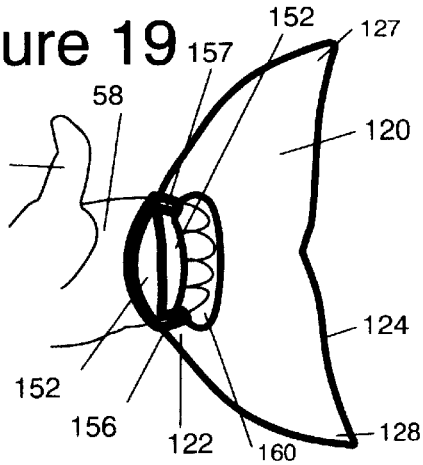
FIG. 19 is a perspective view of the handle pad secured to the handle portion of the hand fin apparatus.

As shown in FIG. 18 and FIG. 19, an auxiliary handle pad 152 may be reusable, releasably secured to the handle portion 140 with a releasable securement means 154, such as a hook and loop fastener. Preferably, two straps 156, 157 are used to secure the auxiliary handle pad 152 to the handle portion 140. The auxiliary handle pad 152 preferably includes a finger ridge 158. The finger ridge 158 is an elongated wedge shape 159 that helps to form the handle portion 140 by extending the elongated wedge shape 159 into the finger well 160. The elongated wedge shape 159 allows the knuckles of the user's hand 58 to wrap over the elongated wedge shape 159 to achieve a superior grip, more comfort, and better control of the hand fin apparatus 100, during use.

The leading edge 122 of the hand fin apparatus 100 extends to opposing first and second trailing points 127, 128. The trailing points 127, 128 are preferably located below the trailing edge 124 of the hand fin apparatus 100, where the leading edge 122 and the trailing edge 124 join.

The leading edge 122 of the hand fin apparatus 100 is wrapped around the centerline 116. This causes the water 112 flow to be directed away from the opposing sides 107, 109 of the hand fin apparatus 100 towards the centerline 116. Water flows over the outer surface 120 of the hand fin apparatus 100 towards the focusing raceway 126. By directing water from the sides toward the centerline 116 as the hand fin apparatus 100 is moved through water 112, substantial smaller vortices form and reducing drag. The decrease in the effects of the vortices makes moving the hand fin apparatus 100 through the water 112 easier and more efficient in producing useful thrust.

Figure 2:
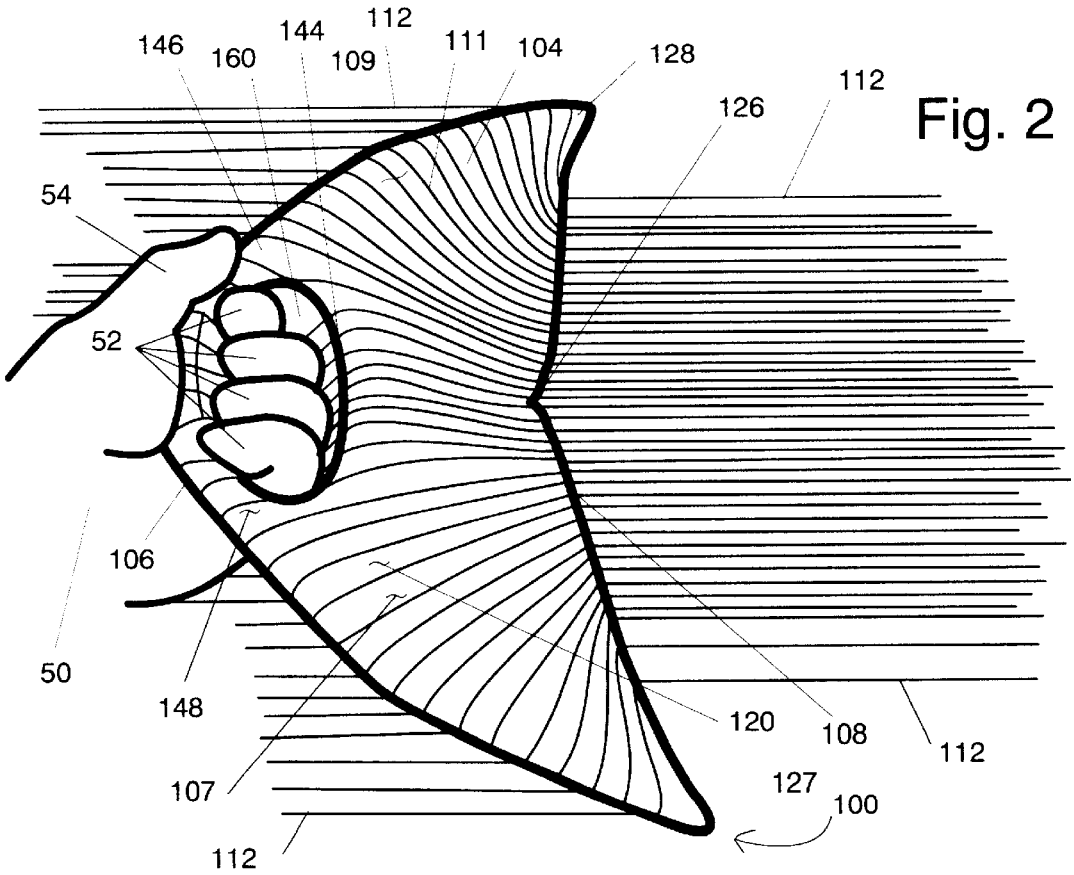
FIG. 2 is a perspective view of the hand fin apparatus, showing the hand of a user grasping the handle portion of the hand fin apparatus, with topographical lines showing the flow of water across the aerodynamically shaped hand fin apparatus.

As shown in FIG. 2, the water flow (112) is directed over the opposing sides 107, 109 of the hand fin apparatus 100, and the aerodynamic shape of the hand fin apparatus 100 serves to concentrate the water 112 flow toward the centerline of the hand fin apparatus 100, and the focusing raceway 126. The user's hand 58 grips the handle portion 140 by wrapping the user's fingers 52 of the user's hand 58 around the finger ridge 158 in this embodiment.

The water 112 flows through the handle portion 140 over the leading edge of the finger well 160, and then over the lifting surface 130 and toward the focusing raceway 126 enhancing lift. The ergonomic handle portion 140 enhances performance while also giving the user's hand 58 the ability to control the hand fin apparatus 100 more effectively by allowing the hand fin apparatus to pivot effectively while controlling the angle of attack and other movements with a variety of user hand grips.

FIGS. 3 and 4 show a user's hand 58 holding the hand fin apparatus 100 from opposite perspectives, top and bottom sides 103 and 104. In FIG. 4, the fingers 52 of the user's hand 58 wrap more completely around the handle portion 140 than they do in FIG. 2. As shown in FIG. 4, the second row of knuckles of the user's fingers 52 are grasping at the handle portion 140.

FIG. 5 shows the user's fingers 52 lightly grasping the handle portion 140 of the hand fin apparatus 100, with the user's thumb 54 extended.

FIG. 6 shows the user's hand firmly grasping the hand fin apparatus 100. This leaves a space in the handle portion 140 through which water can flow.

FIG. 7 shows the user's hand 58 holding one side of the handle portion 140, which enables the user's hand 58 to use slightly different muscles and positions of the thumb 54 and fingers 52 for variation and relief of tired muscles.

FIG. 8 shows another variation for the user's hand 58 grip for grasping the hand fin apparatus 100. By allowing multiple positions for the user's hand 58 to hold the handle portion 140, various effects and benefits are achieved such as relief of tired muscles and altered flow patterns over the hand fin apparatus 100.

FIG. 9 shows first and second sides 172, 174 of an auxiliary wrist, strap 170. The elongated auxiliary wrist strap 170 is used to assist the user 50 with movement and control of the hand fin apparatus 100 while swimming. The auxiliary wrist strap 170 also has the added benefit of supporting the user's wrist 56 during swimming. The auxiliary wrist strap 170 is preferably made of a flexible cloth-like material that is preferably stretchable and synthetic.

A releasable securement means 154, such as hook and loop fasteners, are preferably used to secure the auxiliary wrist strap 170 about a user's wrist 56. Preferably, the auxiliary wrist strap 170 comprises a smooth type of material, suitable for use against the user's skin when wrapped around the user's wrist 56.

The releasable securement means 154 is positioned to secure the distal end 179 of the auxiliary wrist strap 170 to one of the first or second sides 172, 174 of the auxiliary wrist strap 170 around, the user's wrist 56, as seen in FIG. 10. A wrist strap aperture 175 serves to allow the tip end 179 of the wrist strap 170 to be pulled through the wrist strap aperture 175 to form a loop around the handle portion 140 of the hand fin apparatus 100.

A recesses 177 on either side of the wrist strap aperture 175 helps the wrist strap remain broad against the user's wrist 56 after it has been pulled through the wrist strap aperture 175. This feels more comfortable against the user's wrist 56 and provides a better surface on which to releasably secure the tip end 179 of the wrist strap to the user's wrist 56. The wrist strap 170 also allows the swimmer to release the hand fin apparatus 100 during use, without loosing or misplacing the hand fin apparatus 100. This allows the user 50 to maintain basic control of the hand fin apparatus 100 while swimming.

FIG. 10 shows the hand fin apparatus 100 loosely attached to the user's wrist 56. This leaves the user's hand 58 free to be used in any manner that the swimmer desires, while the hand fin apparatus 100 is always in a ready position nearby for immediate use.

FIGS. 11–13 show the steps used to attach the wrist strap 170 to the hand fin apparatus 100. FIG. 11 shows the wrist strap 170 being pulled through the handle portion 140. One hand is shown holding the wrist strap aperture 175 while the other hand is holding the distal end 179 of the wrist strap 170. In FIG. 12, the distal end 179 of the wrist strap 170 has been placed through the wrist strap aperture 175, and is being pulled through the wrist strap aperture 175 to form a loop that secures the wrist strap 170 to the handle portion 140 of the hand fin apparatus 100. FIG. 13 shows the wrist strap 170 firmly pulled into an engaging position about the handle portion 140 of the hand fin apparatus 100.

Figure 14:
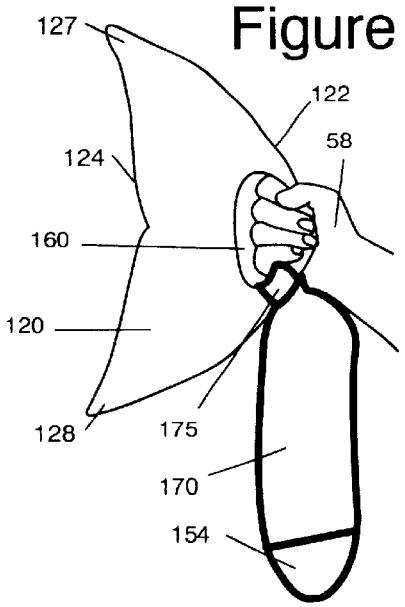
FIG. 14 is a detailed perspective view of the hand fin apparatus, with wrist strap attached, and a user's hand positioned to grasp the handle portion of the hand fin apparatus.

FIGS. 14–17 demonstrate how the wrist strap 170 is wrapped around the users wrist 56, and secured about the user's wrist 56 to aid in the movement and control of the hand fin apparatus 100. In FIG. 14, the user's hand 58 is grasping the handle portion 140 of the hand fin apparatus 100, with the wrist strap 170 secured to the handle portion 140, and hanging down from the hand fin apparatus 100.

Figure 15:
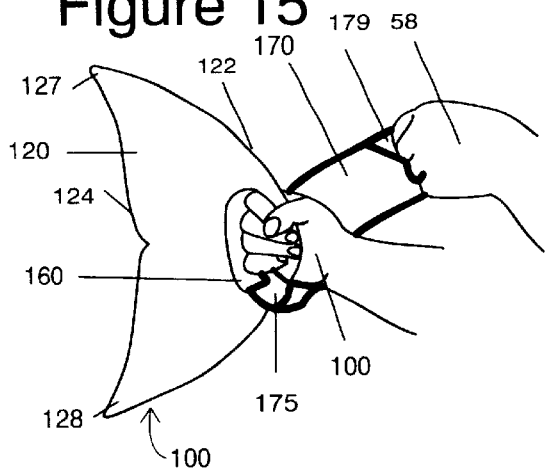
FIG. 15 is a perspective view of the hand fin apparatus, with the user pulling the wrist strap about the user's wrist.
Figure 16:
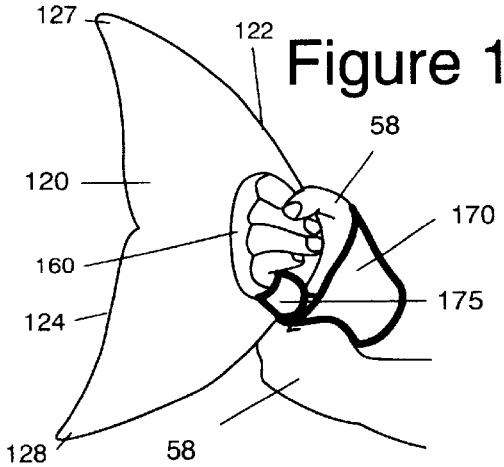
FIG. 16 is a perspective view of the hand fin apparatus, showing the wrist strap wrapped about the user's wrist.

FIG. 15 demonstrates how the user's free hand 58 can grasp the distal end 179 of the wrist strap 170, and pull the wrist strap 170 around the user's wrist 56. FIG. 16 shows the user's free hand 58 holding the distal end 179 of the wrist strap 170, and releasably securing the wrist strap to itself with the releasable securement means 154. This secures the wrist strap 170 around the user's wrist 56, which gives the user's wrist 56 additional support to control and leverage the hand fin apparatus during use in water.

The wrist strap 170 is preferably made of pliable, stretchable material, so that it can be stretched and pulled securely around a user's wrist 56 to create extra support for the users wrist 56, and to provide a tighter connection to the hand fin apparatus 100.

As shown in FIGS. 18 and 19, an auxiliary handle pad 152 is preferably provided for attachment to the handle portion 140 of the hand fin apparatus 100. The auxiliary handle pad 152 is preferably attached to the handle portion 140 by at least one strap 156, which is releasably secured to the handle portion 140 with a suitable releasable securement means 154, such as a combination hook and loop fastener. Two straps 156, 157 may alternately be used to secure the auxiliary handle pad 152 to the handle portion 140.

The wrist strap 170 may also be used to secure a variety of accessories (not shown) that might be needed during diving sessions. This feature would help control the accessories within a work area that might be clouded with silt, or in other vision impairing situations. In extreme situations, the wrist strap could also be used as an efficient, controllable tourniquet in case of cuts, accidents, or shark attacks.

Gloves (not shown) may alternately be used in a similar manner to the wrist strap 170, by using straps attached to the gloves to secure the hand fin apparatus 100. The straps may use small hooks and loops built into the cloth material, or they may use the same method used by the wrist strap to secure the handle or any other means for securing the glove to the handle portion 140 of the hand fin apparatus 100. The gloves may have padding in the palm of the gloves to make the grip of the swimmer more comfortable.

Figure 17:
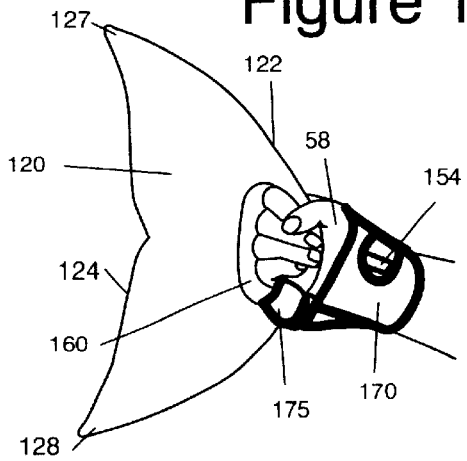
FIG. 17 is a perspective view of the hand fin apparatus, with the wrist strap secured about the user's wrist with a releasable fastening means, in preparation for use.

FIG. 17 illustrates the hand fin apparatus 100 securely attached to the user's wrist 56 with the aid of a wrist strap 170. Two sets of straps 156, 157 may be used to attach an auxiliary handle pad 152 to the handle portion 140 of the hand fin apparatus 100. The two straps 156,157 may also be used to strap around tools such as a hammer or a bag (not shown) and thus hold these items connected to the handle portion 140. This allows the user 50 to carry any item that may be needed close at hand, or for temporary storage while using the hand fin apparatus 100.

The auxiliary handle pad 152 adds more volume to the handle portion 140 to accommodate larger hands 58. The auxiliary handle pad 152 also gives each user 50 a variable handle size that enables the user 50 to have a variety of gripping positions, to involve different muscles at different times, which helps reduce muscle fatigue while swimming. The auxiliary handle pad 152 also softens the stress against the palm of the user's hand 58.

Extra auxiliary handle pads 152 can also be strapped to the handle portion 140 of the hand fin apparatus 100 for additional padding and to increase the size of the handle. Storing the extra auxiliary handle pads 152 while swimming would be extremely easy, since each auxiliary handle pad 152 can be attached to each other and to the wrist strap 170, with the releasable securement 154 means provided. The releasable securement means may be any known releasable securement means, such as hook and loop fasteners, buttons, snaps, catches, etc.

Figure 20:
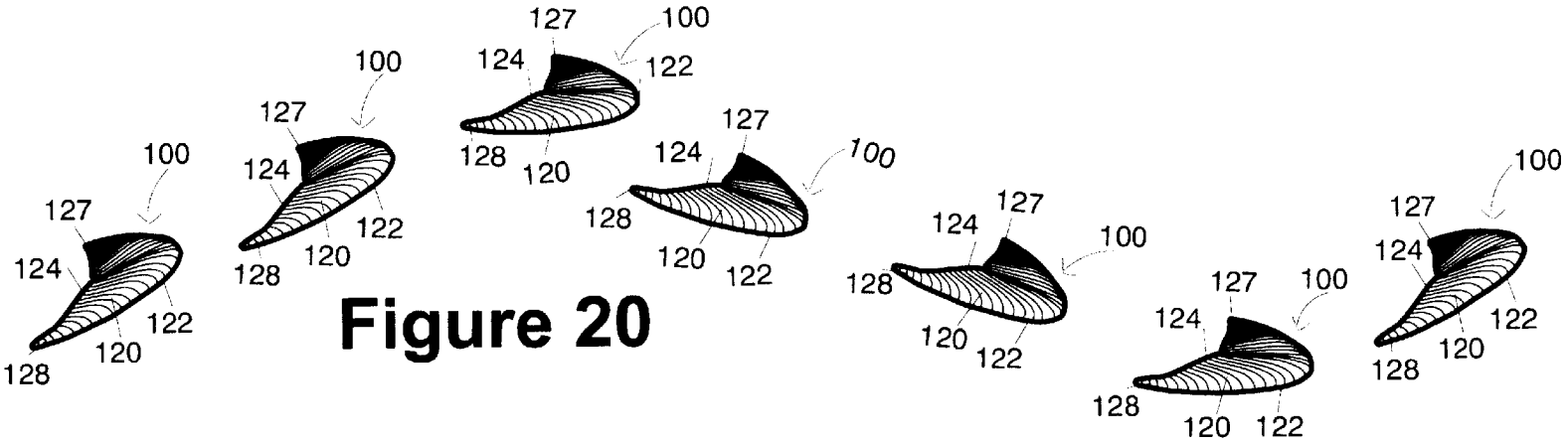
FIG. 20 is a sequential flow diagram showing the hand fin apparatus flowing through the water illustrating the proper angle of attack.
Figure 21:
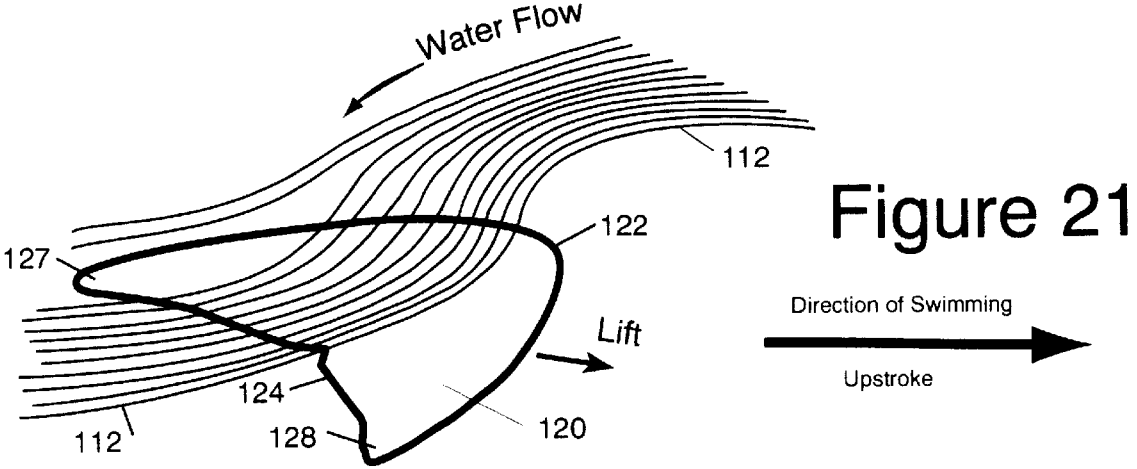
FIG. 21 is a schematic view of the hand fin apparatus showing the water flow during an upstroke that generates lift about the aerodynamic hand fin apparatus.

FIG. 20 illustrates a sequential series of drawings of the sine wave type pattern that the proper angle of attack for the hand fin apparatus 100 takes normal during use (similar angles of attack for whales flukes, tail fins, and fish caudal fins, tail fins, can be found in the accompanying literature on the recent scientific studies of these animals). The embodiments in FIG. 20 reveal very slight deflections in the surface 120 for the handle portion. FIG. 21 illustrates the water 112 flowing over the outer surface 120 of the hand fin apparatus 100. FIG. 22 is a cross sectional view of FIG. 21 showing how lift is generated by flowing water 112 over the aerodynamic shape of a rigid trailing edge 124 of the hand fin apparatus 100. It also demonstrates a simplified version of the trailing vortices, called Reverse Von Karmen Street Vortices 114, curling away from the trailing edge 124 and creating a thrust vector 135 (the triple arrow line) in the water. FIG. 23 is a cross sectional view of an alternative of hand fin apparatus 100 showing how lift is generated by flowing water 112 over the aerodynamic shape of a flexible trailing edge 124. The double arrow 134 is the resulting down thrust caused by the speeding water over the lifting surface 130 in FIGS. 22 and 23. The pressure surface 132 in FIGS. 22 and 23 is only the pressure surface when the angle of attack (pitch) is in its present position. The pitch of the surfaces 130 and 132 influences whether the surface is lifting or pressure.

FIG. 24 is a perspective view of the hand fin apparatus 100, showing the use of a leading edge 122 cast portion with reinforcing rod 180 extending on opposite sides 107, 109 from the leading edge 122 cast portion, to provide an aerodynamic airfoil shape. FIG. 24 shows the partial casting of the hand fin, where the handle portion 140 is easily discernible. This casting could be done with a relatively rigid polyurethane or similar material so that the handle portion 140 could exert direct influence on the hand fin apparatus 100.

A mandrel or a loop of rigid material would form a reinforcing rod 180 to reach through the interior of the hand fin up to the trailing plug tips 198, 199 of the hand fin apparatus 100. The rest of the material is then cast with a much softer and more flexible material. The curved leading edge of the hand fin apparatus 100 would remain relatively rigid because of the rigid polyurethane base, as seen in FIG. 24, and the rigid wire loops forming a reinforcing rod for the hand fin apparatus 100, however, the more flexible material would be easier to flex.

FIG. 25 is a perspective view of the hand fin apparatus 100, showing the use of a leading edge 122 cast portion with a triangular shaped reinforcing support 182 extending on opposite sides 107, 109 of the leading edge 122 cast portion, to maintain an aerodynamic airfoil shape. As shown in FIG. 25, the reinforcing rod shown in FIG. 24 is replaced by rigid triangular polyurethane forms cast with the handle portion 140, or cast from the secondary material over the rigid triangular polyurethane forms. These rigid triangular polyurethane forms interact with the casting of a much softer and more flexible material to give the flexible material a rigid support. This rigid support helps keep the leading edge of the hand fin apparatus 100 more rigid.

The thin flat shape in the center rear portion 184 of the hand fin apparatus, is partially by a dashed line 186 in FIG. 26. This view is a perspective view of the hand fin apparatus 100, showing a flexible portion 184 extending from the dashed line 186 to the trailing edge 124 of the hand fin apparatus 100.

FIG. 22 illustrates an approximate cross-section of the hand fin apparatus 100 as illustrated in FIG. 21 with its lifting surface 130 and pressure surface 132 shown with water flowing over the rigid hand fin apparatus 100 at a proper angle of attack. The double arrow 134 pointing down represents the water 112 pressure caused by moving this hand fin apparatus 100 through the water 112 in the direction of the single arrow 136 on a horizontal axis. Because the water 112 above the hand fin apparatus 100 has to flow a longer distance than the water 112 passing below the hand fin apparatus 100, lifting surface 130 is created by the hand fin apparatus 100 moving through the water 112 at this angle of attack.

In FIG. 23, the same double arrow 134 represents water 112 pressure against the flexible trailing edge surface 184. In this case, the flexible trailing edge surface 184 bends under the water 112 pressure to create a greater distance that the water 112 must flow relative to the distance below the hand fin apparatus 100. This has two desirable effects in that it takes less force to move the hand fin apparatus 100 through the water 112 when there is less resistance from the flexible trailing edge surface 184, and the longer flow distance creates more lift over the lifting surface 130 to aid with swimming.

This change in the shape of the hand fin apparatus 100 is further illustrated in FIGS. 27 through 30. FIG. 27 shows a rear view of the hand fin apparatus 100. The first and second trailing points 127, 128 the trailing edge 124, the handle portion 140, and the lifting surface 130 can be clearly seen with the topographical surface flow lines 111 shown. The dashed line 186 running roughly parallel to the trailing edge 124 shows the flat trailing edge 124 on a rigid form hand fin apparatus 100 when moving through the water 112 at a proper angle of attack.

FIG. 28 shows a similar hand fin apparatus 100 made with materials so that the trailing edge 124 surface is flexible, and bends to increase the overall lifting surface 130 area. This increase in lifting surface 130 area on the hand fin apparatus 100 means an increase in the force of lift acting on the hand fin apparatus 100, which aids in swimming.

FIG. 29 shows the rigid form of the hand fin apparatus 100 when traveling through the water 112 at a proper angle of attack and under water 112 pressure generated by this movement. FIG. 30 shows the change in area created when the trailing edge surface 124 is flexible because of the use of flexible-materials, as described above.

In other embodiments, the handle 140 can have flexible material used in the sides of the handle 146 and 148, as seen in FIG. 2, to create a proper pitch for the hand fin apparatus 100. The flexible materials are selected to create a self-regulating pitch, which stems from a combination of physical structure and the selection of a material used. The internal material geometry of the selected materials affects the overall performance of the hand fin apparatus 100. This compliant geometry dictates the self-regulating pitch of the hand fin apparatus 100. The self-regulating pitch is selected to be less than 30 degrees and is preferably between 15 and 20 degrees.

FIG. 31 through FIG. 34 illustrate an alternative focus raceway 126 where the area that composes the flat flexible trailing edge surface 124 is bisected by the focus raceway 126 and actually becomes two adjacent flaps that overlap at the focus raceway 126. In FIG. 31, the hand fin apparatus 100 is shown at rest, and the area between the dashed line 186 and the trailing edge 124, forming the flexible flat surface 184, forms the focus raceway 126.

In FIG. 32, the hand fin apparatus 100 is seen under pressure as it travels through the water 112 under pressure at the proper angle attack for creating lift. The change that takes place when this multiple material hand fin apparatus 100 is placed under pressure, is that the flat flexible surface area 184 bends down as before, but in this case, the overlapping flaps of the focus raceway 126 pull apart to form a "v" shape directly down the center line 116 of the hand fin apparatus 100. This provides additional surface area for the creation of lift that aids in swimming.

FIG. 33 shows the hand fin with the overlap at the focus raceway 126 when the hand fin apparatus is at rest. FIG. 34 shows the hand fin apparatus 100 under pressure as it is moved through the water 112 at the proper angle of attack. In FIG. 34, the flexible trailing edge surface 184 bends to form a "v" shape down the centerline 116 of the hand fin apparatus 100, increasing the lifting surface area and therefore lift. This increase in lift is fortunately gained with no increase in effort since the water 112 pressure of the hand fin apparatus 100 moving through water 112 at the proper angle of attack, increases the overall lifting area.

FIG. 35 is a perspective view of an inflatable hand fin apparatus 101, further disclosed herein. An inflatable air valve 190 is provided to selectively inflate and deflate the inflatable hand fin apparatus 101. This air valve 190 is substantially similar to air valves found on inflatable toys. This air valve 190 would preferably have a side tube 194 for easy handling during inflation that would be able to be pushed within the inflatable hand fin apparatus 101, and has an attached air valve cap 191 to stop leaks. Preferably, this air valve 190 would have a larger aperture or tube, so that water 112 could be more easily used to fill the inflatable hand fin apparatus 101.

Liquid, preferably water, would be poured or scooped into the collapsible funnel 192, so that the liquid could pour through the collapsible funnel 192 into the inflatable hand fin apparatus 101. The inflation tube 194 would have an exterior diameter that would be closely received into the interior diameter of the inflation valve 190 located on the inflatable hand fin apparatus 101. This inflation tube 194 would be long enough to push open the interior flap (not shown) on the inflation valve 190, which would make inflation easier. After the desired amount of water is inserted within the inflatable hand fin apparatus 101, the final tension on the surface could be achieved by filling the remaining space with air blown into the interior of the hand fin apparatus 101 with the inflation valve 190.

FIG. 37 shows an inflation syringe 196, which is made of hard plastic, metals, or rigid polyurethane etc. The inflation syringe 196 may be larger for quicker and more powerful inflation or smaller so that carrying the inflation syringe 196 would be easier. The inflation syringe 196 will provide either air or a liquid into the interior of the hand fin apparatus 101 in a manner similar to use of the collapsible funnel 192, previously disclosed.

FIG. 35 shows a perspective view of the inflatable hand fin apparatus 101. The inflatable hand fin apparatus 101 is substantially similar to the non-inflatable hand fin apparatus 100, with the exception of an inflation valve 190 in fluid communication with an interior chamber 188 surrounded by the outer surface 120 of the inflatable hand fin apparatus 101. The inflatable hand fin apparatus 101 is preferably made of rubberized woven nylon, or other strong, air tight, pliable materials. Besides having all of the advantages of rigid and multi-material hand fin apparatus previously disclosed, the inflatable hand fin apparatus 101 provides additional novel improvements. The inflatable hand fin apparatus 101 disclosed herein could be emptied to make the inflatable hand fin apparatus 101 easier to transport in size and weight.

The inflatable hand fin apparatus 101 may be inflated entirely with air, and used as flotation devices in emergencies. The inflatable hand fin apparatus 101 would be especially useful as flotation devices when used in conjunction with wrist straps 170, because the wrist straps would assist in securing the inflatable hand fin apparatus to the user 50. In extreme conditions (for example military operations), the inflatable hand fin apparatus 101 could originally hold potable water 112, that could be consumed during a mission, subsequently replaced with available water 112, to provide a neutral buoyancy of the hand fin apparatus 101. With the water removed, the inflatable hand fin apparatus 101 could then be used as a flotation device.

Figures 38, 39, 40, 41:
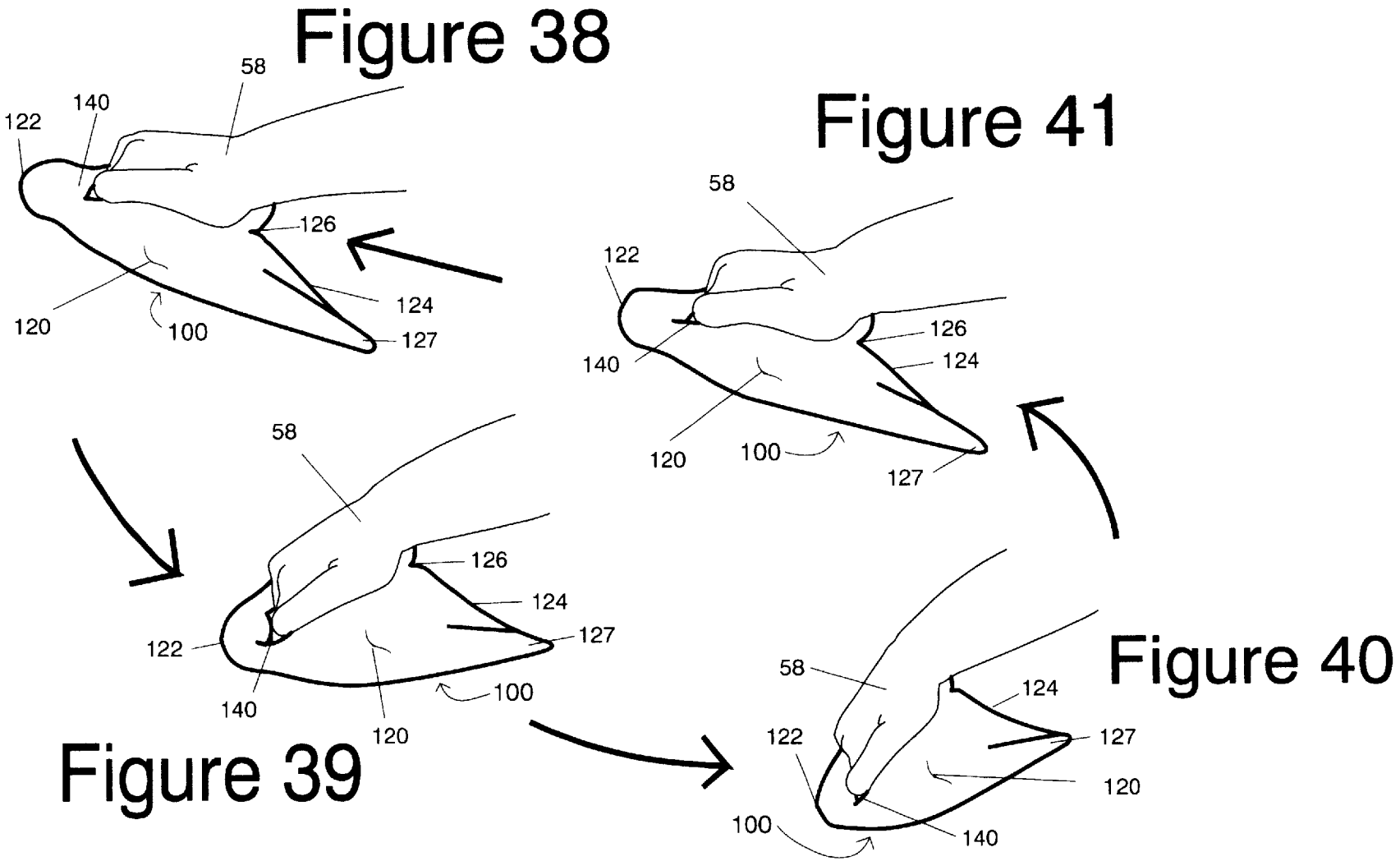
FIG. 38 is a perspective view of the hand fin apparatus, showing an alternative manner of grasping the hand fin apparatus nearing the top phase of a forward up stroke.
FIG. 39 is a perspective view of the hand fin apparatus shown in FIG. 38, during a mid stage of a downward backstroke.
FIG. 40 is a perspective view of the hand fin apparatus shown in FIG. 38, nearing the end of the downward backstroke.
FIG. 41 is a perspective view of the hand fin apparatus shown in FIG. 38, during a mid stage of the forward up stroke.

FIG. 38 through FIG. 41 illustrates an alternative method of grasping the hand fin apparatus 100 or 101, by placing the fingers 52 of the user's hand 58 through the handle portion 140, with the user's hand 58 and thumb 54 (pointing towards the leading edge) positioned behind the handle portion 140, towards the trailing edge 124. This would position the user's hand 58 behind the leading edge 122. Since the hand is behidd the leading edge, these figures also show a sequence, when consider together, for a forward reaching swimming stroke. By grasping the hand fin apparatus 100 or 101 in this manner, the swimmer can use the hand fin apparatus 100 or 101 both for its ability to create lift and for its ability to act as a semi paddle. By lifting the hand fin apparatus 100 or 101 and moving the hand fin apparatus 100 or 101 forward as seen in FIGS. 38 and 41, the surface of the hand fin apparatus 100 or 101 creates lift as previously discussed in the description of FIGS. 22 and 23.

The position of the hand fin apparatus 100 or 101, as seen in FIGS. 38–41 allows the user to use the hand fin apparatus 100 or 101 as a semi paddle during the down and back stroke (notice the direction of the arrows in FIGS. 39 and 40 and refer to the article on the MOVEMENT OF A DOLPHIN FLIPPER for more scientific explanations of this stroke in nature). The lift produced in the forward motion of the hand fin apparatus 100 or 101 allows the swimmer to offset the drag that normally accompanies bringing the user's 50 arm forward while swimming underwater. This allows the user to use the strong muscles in the chest and back for pulling down and back. The motion is sometimes described as a "dog paddle" type swimming stroke.

Without the lift produced during the forward motion of the hand fin apparatus 100 or 101, and the added surface area of the hand fin apparatus 100 or 101, when used as a paddle in the down and back stroke, this type of motion is counterproductive when simply using the hands and arms while swimming with fins on the swimmer's feet. Using the hand fin apparatus 100 or 101 in this manner also allows for more control of the, angle of attack of the hand fin apparatus 100 or 101 making the swimming effort more efficient.

FIGS. 42 through 46 show the same manner of swimming stroke described in FIGS. 38 through 41. The manner of grasping is similar except that the trailing edge 124 of the hand fin apparatus 99 more closely follows the leading-edge 122 in its shape. This allows the user's hand 58 to grasp the hand fin apparatus 99 with a grasp that allows the user's thumb 54 to reach around the trailing-edge 124 and touch the fingers 52 of the user's hand 58 that extend through the finger well 160 of the handle portion 140.

Figures 42, 43, 44, 45, 46:
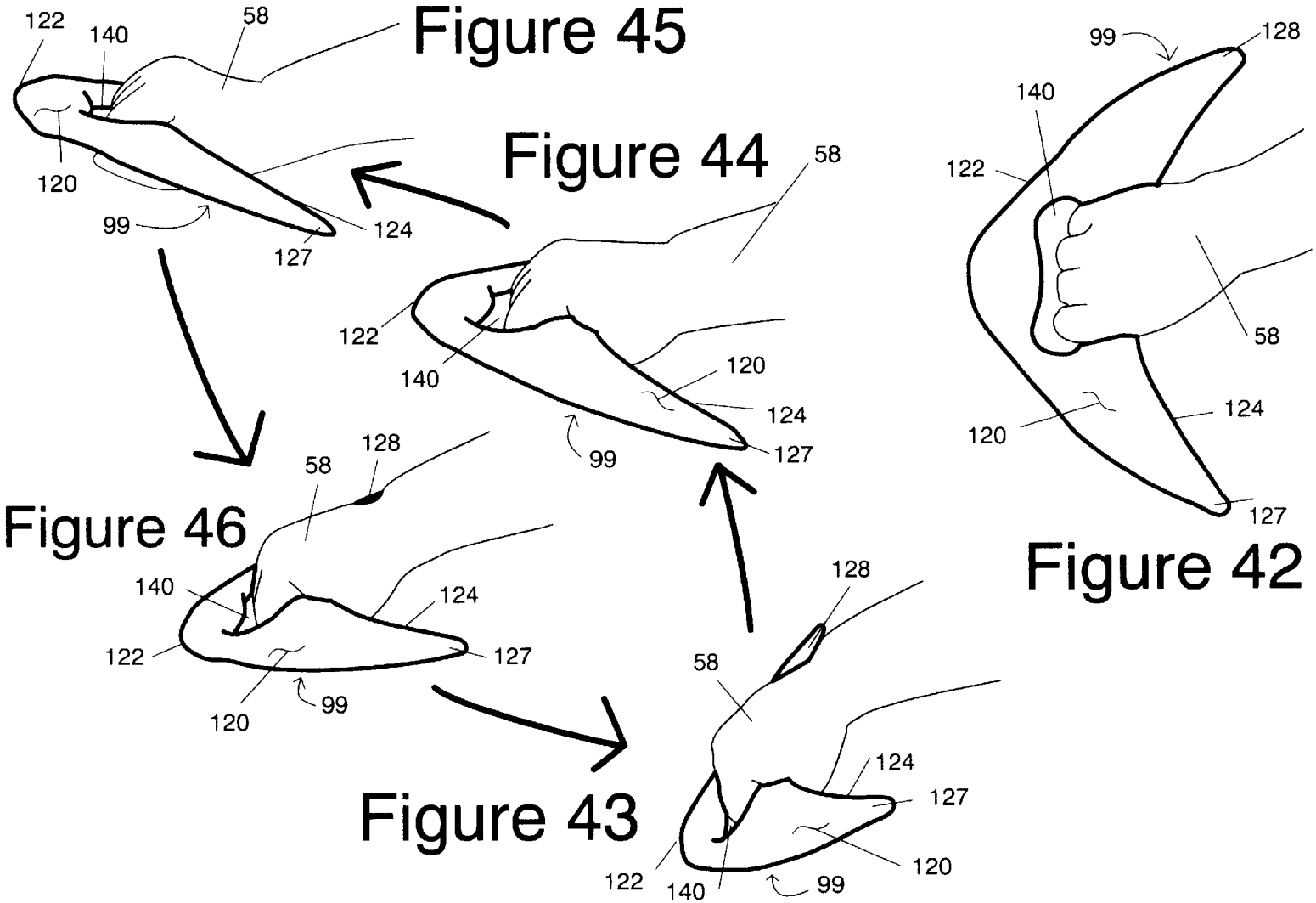
FIG. 42 is an alternate perspective view of the hand fin apparatus wherein the handle portion is grasped from the rear portion of the hand fin apparatus.
FIG. 43 is a perspective view of the alternative grip on the hand fin apparatus shown in FIG. 42, nearing the end of the downward backstroke.
FIG. 44 is a perspective view of the alternative grip on the hand fin apparatus shown in FIG. 42, during a mid stage of the forward up stroke.
FIG. 45 is a perspective view of the alternative grip on the hand fin apparatus shown in FIG. 42, during a mid stage of a downward backstroke.
FIG. 46 is a top view of the alternative grip on the hand fin apparatus shown in FIG. 42, during a mid stage of a downward backstroke.
Figure 46A:
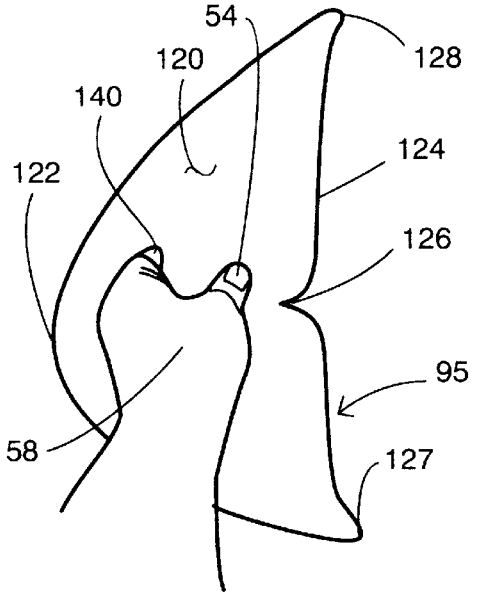
FIG. 46A is a perspective view of another alternative grip of a hand fin where the thumb and fingers of the hand point towards the trailing edge of the hand fin.

The shape of this hand fin apparatus 99 with its altered trailing-edge 124 is better seen in FIG. 42. These variations for grasping the fins and the alternative "lift" and "pull" swimming strokes are only some of the many possible alternative grips and strokes that can be used with the hand fin apparatus disclosed herein.

This invention uses lifting surfaces to gain a mechanical advantage when swimming. The great advantage of using lift is that it functions independent of speed and increases efficiency with speed. It is therefore an excellent process to use for swimming with the hands while using foot fins. The use of a wrist strap 170 or glove enhances the power and control of the hand fin apparatus 100 or 101.

The use of multiple materials with rigid internal structure and flexible materials for the flat thin structures enables the flexible trailing edge surface 184 to distort underwater pressure and produce larger lifting surfaces that produce greater lift during use. Inflatable hand fins 101 offer improved transportation and storage, as well as the ability to convert the inflatable hand fin apparatus 101 into flotation devices.

Figure 47:
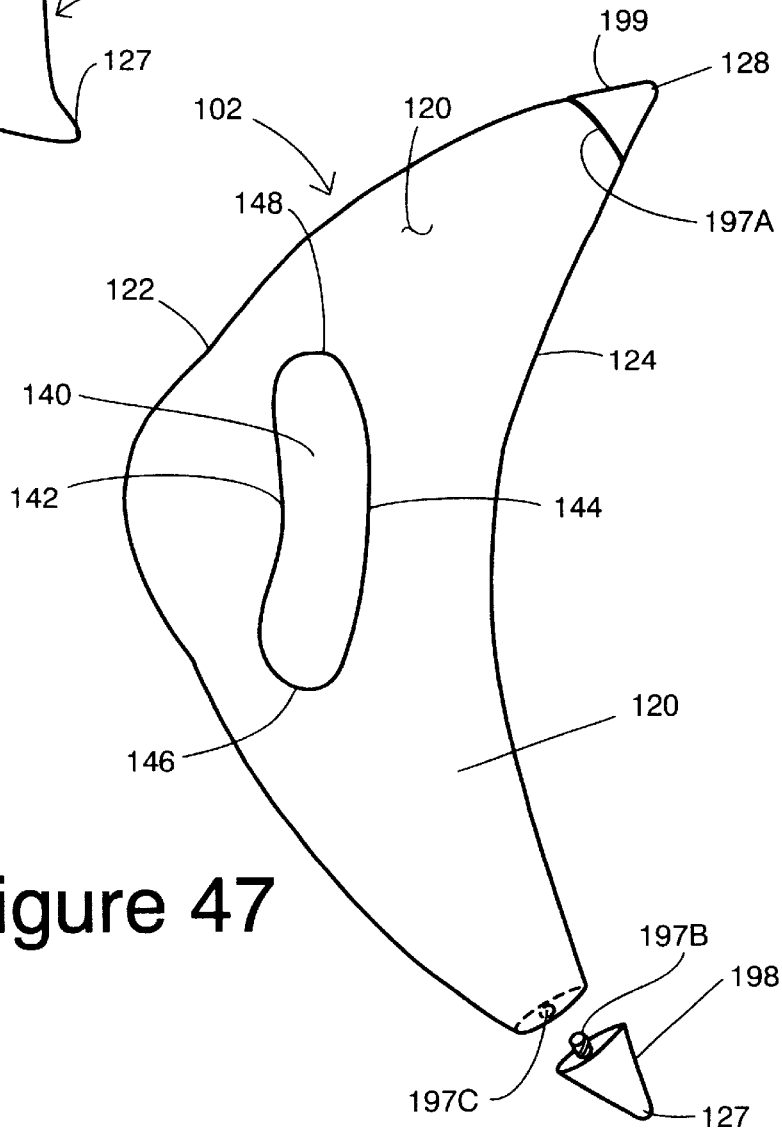
FIG. 47 illustrates a hollow hand fin using removable plugs releasably secured in apertures located at the distal trailing ends of the hand fin apparatus.

FIG. 47 illustrates a hollow hand fin apparatus 102. The hollow hand fin apparatus 102 can be used in any of the activities mentioned for the inflatable hand fin apparatus 101. The hollow hand fin apparatus 102 can be filled with air and used for floatation, or simply filled with water to provide a neutral ballast hand fin, for use in water. The hollow hand fin apparatus 102 can be easily filled with water 112 by unplugging the first and second plug-tips 198, 199, preferably by twisting the threaded plug 197B to release it from the plug tip aperture 197C at the plug tip seam 197A, to expose the upper and lower apertures 197C, and submerging the lower plug tip aperture 197C to fill the hollow hand fin apparatus 102 to a desired level. As the lower plug tip aperture 197C fills with water, air inside the hollow hand fin apparatus 102 escapes through the upper plug tip aperture 197C. In this manner, the hollow hand fin apparatus 102 may be easily and quickly filled to any desired level with water, to achieve the desired level of buoyancy. Any known releasable securement means may be used to releasably secure the first and second plug tips 198, 199 to to the first and second trailing point 127, 128 apertures, of the hollow hand fin apparatus 102. Such releasable securement means include the use of complimentary engaging threads, twist lock engaging members, removable plug members, etc.

The lower plug tip 198 and upper plug tip 199 are releasably secured to the first and second trailing point, 127, 128 distal ends, respectively. A selected amount of water 112 may be added to the hollow hand fin apparatus 102. By selectively filling the hollow hand fin apparatus 102 to a desired level, one can create useable weights for water aerobics. The hollow hand fin apparatus 102 provides a selected resistance in the water 112 for a more complete water aerobics workout. By partially filling the hollow hand fin apparatus 102, the floatation qualities of the hollow hand fin apparatus 102 can be easily controlled. The hollow hand fin apparatus 102 can be used employing these controlled floatation qualities for various advantageous effects.

FIG. 48 shows the hand fin apparatus 100 with handle 140 symmetrically positioned about the centerline 116 between the leading edge 122 and the trailing edge 124.

FIG. 49 is a cross-section view taken along the centerline 116 of the hand fin apparatus 100 shown in FIG. 48. The solid portions have hatched lines.

FIG. 50 is a cross-sectioned view of the hand fin apparatus 95 taken from the centerline in FIG. 51 with a flexible upper flap 145 and flexible lower flap 147, extending from the top flap contact edge 145A and lower flap contact edge 147A to the flap edge 149. These flexible flaps 145 and 147 partially cover the handle portion 140 providing a finger support; creating better laminar flow of water 112, and aiding in manipulating the hand fin apparatus 95. The finger ridge 158 extends from the leading handle edge 142 to the upper and lower flap contact edge 145A and 147A to provide a finger support to aid in manipulating the hand fin apparatus 95. The finger ridge 158 may be convex as shown in FIG. 50 or concave as shown in FIG. 56 through FIG. 60. The solid portions have hatched lines.

The flexible flaps 145 and 147 preferable extend above and below the handle portion 140, and is sufficiently flexible to enable the user to insert their fingers between the flexible flaps 145 and 147 and the handle portion 140. When necessary, flexible flap slits 149A and 149B can assist with allowing the user's hand entry to the handle portion 140 as seen in FIG. 51.

FIG. 51 is a perspective view of the hand fin apparatus with flexible flaps 95 with the centerline 116 shown in the cross-section in FIG. 50.

Figure 52:
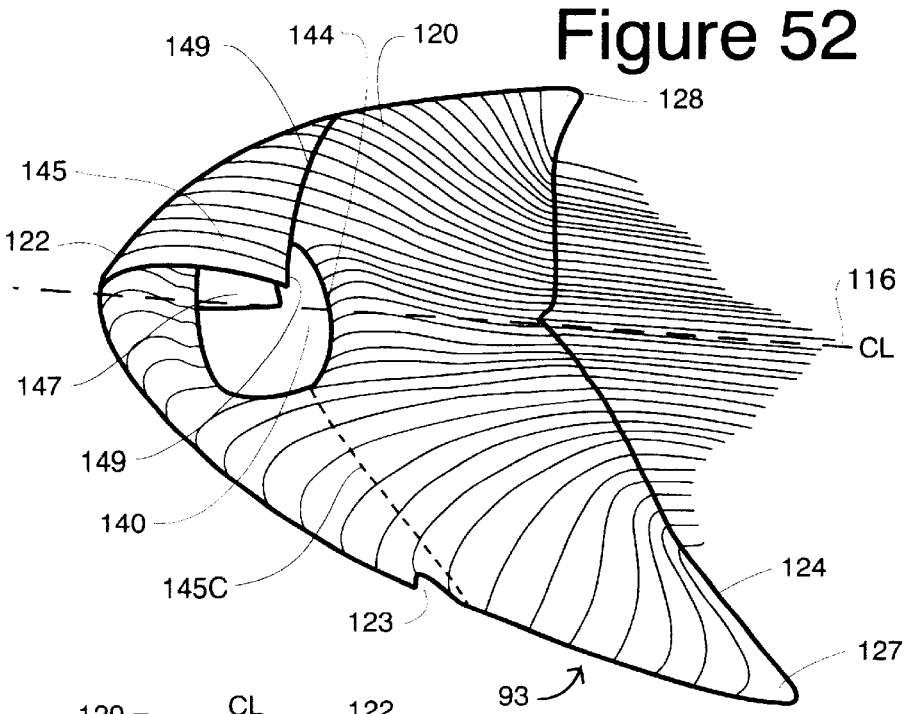
FIG. 52 is a side view perspective drawing of another alternative hand fin where the flexible flap is cutaway at the centerline to better reveal the handle form. The notch on the leading edge of the hand fin assists in securing the flap to the hand fin.

FIG. 52 is a partial cutaway view of the hand fin apparatus 93 with a removable flexible flap. Opposing leading edge notches 123 are provided in FIG. 52 to aid in securing the removable flexible flap from the leading edge 122 of the hand fin apparatus 93.

FIG. 52 is aperspective top view of an asymmetrical hand fin apparatus 98, wherein the handle portion 140 is positioned between a larger opposing side 109 and a smaller opposing side 107. The first side 103 is aerodynamically shaped as shown by topographical lines 111. It can also be seen in the cross-section view in FIG. 55 taken from the centerline 116 in FIG. 53.

Figure 53:
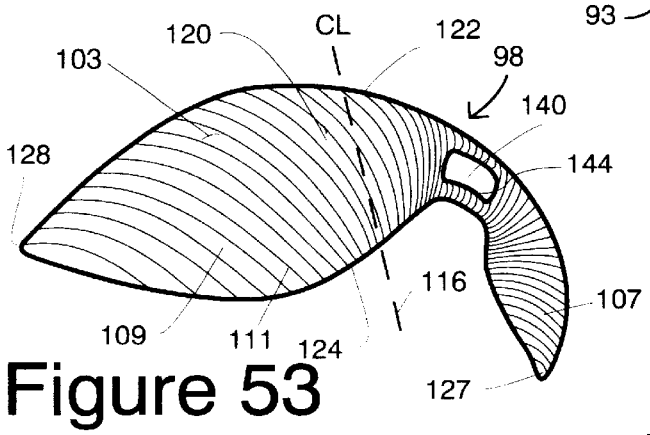
FIG. 53 is a top view of an asymmetrical hand fin where the two adjacent airfoils are not equal in area and the top of the airfoil is a curved aerodynamic shape.
Figure 54:
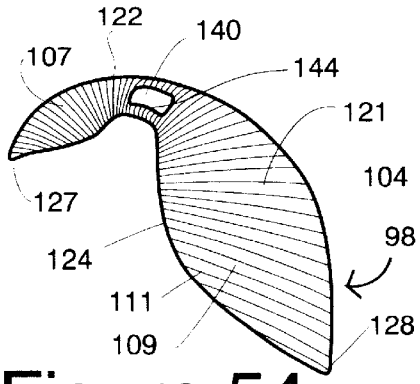
FIG. 54 is a bottom view of an asymmetrical hand fin where the two adjacent airfoils are not equal in area and the top of the airfoil is relatively flat.
Figure 55:
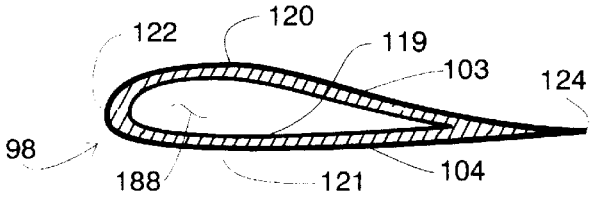
FIG. 55 is the cross-section view taken along to the centerline in FIG. 53.

FIG. 54 is a perspective bottom view of an asymmetrical hand fin apparatus show in FIG. 53, wherein the bottom side 104 is substantially flat, as shown by topographical lines 111 and the cross-section in FIG. 55.

FIG. 55 is a cross-sectional view taken from the centerline of FIG. 53, of the hollow hand fin apparatus 98 sharing a chamber 188 found between the tope side 103 and the bottom side 104.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A hand fin apparatus, comprising:

an aerodynamic exterior hand fin surface with a curved leading edge having a first thickness; a curved trailing edge positioned in spaced relation from the leading edge, the leading edge and the trailing edge joined at opposing first and second trailing points, the trailing edge with a second thickness, narrower in thickness than the first thickness of the leading edge;

a main body portion extending between the leading edge and the trailing edge, the main body portion being shaped such that water flowing over the main body portion is guided toward a centerline of the hand fin apparatus; and a handle portion positioned across the centerline of the hand fin apparatus, the handle portion further positioned between the leading edge and the trailing edge of the hand fin apparatus, the handle portion sized to receive a user's hand therein.

2. The hand fin apparatus of claim 1, wherein the trailing edge is flexible to generate lift as the hand fin apparatus is moved through water.

3. The hand fin apparatus of claim 1, wherein the handle portion extends entirely through the hand fin apparatus, and the handle portion is sized to allow water to pass through the handle portion to redirect water flow passing over the hand fin apparatus, during use.

4. The hand fin apparatus of claim 3, wherein an auxiliary handle pad is selectively attachable to the handle portion of the hand fin apparatus, to increase a grip size on the handle portion, and to improve control of the hand fin apparatus, during use.

5. The hand fin apparatus of claim 4, wherein the auxiliary handle pad is secured to the handle portion with a first strap releasably secured to opposing ends of the first strap, and a second strap releasably secured to the handle portion with opposing ends of the second strap, and at least one of the first and second straps provide an attachment means for auxiliary gear used in conjunction with the hand fin apparatus.

6. The hand fin apparatus of claim 1, wherein the main body portion includes a third thickness positioned in spaced relation from the leading edge, the third thickness conforming substantially to the shape of the leading edge, the third thickness is thicker than the first thickness located at the leading edge, and the third thickness tapers towards the second thickness located at the trailing edge of the hand fin apparatus.

7. The hand fin apparatus of claim 1, wherein a focusing raceway is formed along the center of the hand fin apparatus, the focusing raceway defined by the main body portion and tapering in thickness toward the centerline of the hand fin apparatus and also tapering towards the trailing edge of the hand fin apparatus, to direct and funnel water flow passing over the hand fin apparatus, to generate lift during use.

8. The hand fin apparatus of claim 1, wherein the hand fin apparatus is inflatable, and an inflation valve is provided to selectively inflate and deflate the hand fin apparatus, and the hand fin apparatus is buoyant when inflated, and compressible to a small size when deflated, for ease of transport and storage.

9. The hand fin apparatus of claim 1, wherein the hand fin apparatus includes a hollow portion forming an internal chamber therein, and a first plug tip is releasably secured to a first aperture located in proximity to the first trailing point, the first aperture in fluid communication with the internal chamber, and a second plug tip is releasably secured to a second aperture provided in proximity to the second trailing point, the second aperture in fluid communication with the internal chamber, and the first and second plug tips are removed from the first and second trailing points to selectively fill the hollow hand fin apparatus with water, and the first and second plug tips are subsequently releasably secured to the respective first and second apertures when the hollow portion of the hand fin apparatus is filled to a desired weight with water, and wherein the water is removed after use, to reduce the weight of the hand fin apparatus, for ease of transport and storage.

10. The hand fin apparatus of claim 1, wherein an elongated wrist strap is attachable to the handle portion of the hand fin apparatus, and an aperture is provided near one end of the wrist strap to receive a second end of the wrist strap therethrough, and the wrist strap is sized to engage the handle portion of the hand fin, and extends beyond the handle portion to be wrapped about a user's wrist, to releasably secure the hand fin apparatus to the user's wrist during use.

11. The hand fin apparatus of claim 1, wherein the handle portion extends between the leading edge and the trailing edge, and between the first and second trailing points of the hand fin apparatus, but does not extend therethrough.

12. The hand fin apparatus of claim 1, wherein the aerodynamic shape of the hand fin apparatus is substantially symmetrical about the centerline.

13. The hand fin apparatus of claim 1, wherein the aerodynamic shape of the hand fin apparatus is substantially asymmetrical about the centerline of the hand fin apparatus.

14. The hand fin apparatus of claim 1, wherein a self-regulating pitch of less than 30 degrees is selected with a combination of physical structure and materials used.

15. The hand fin apparatus of claim 14 wherein the self regulating pitch is preferably selected to be between 15 and 20 degrees.

16. A hand fin apparatus, comprising:

an aerodynamic hand fin apparatus with a substantially symmetrical, aerodynamic dolphin tail shape, the hand fin apparatus with a curved leading edge having a first thickness; a curved trailing edge positioned in spaced relation from the curved leading edge, the leading edge and the trailing edge joined at opposing first and second trailing points, the hand fin apparatus with a trailing edge having a second thickness, narrower in thickness than the first thickness located at the leading edge of the swim fin apparatus, the main body portion includes a third thickness that is thicker than the first thickness located at the leading edge, and the third thickness tapers towards the trailing edge of the hand fin apparatus;

a main body portion extends between the leading edge and the trailing edge, the main body portion shaped such that water flowing over the main body portion is guided toward a center of the hand fin apparatus; and an elongated handle portion positioned across the center of the hand fin apparatus, the elongated handle portion further positioned between the leading edge and the trailing edge of the hand fin apparatus, the handle portion sized to receive a user's hand therethrough.

17. The hand fin apparatus of claim 16, wherein the trailing edge is flexible to generate lift as the hand fin apparatus is moved through water.

18. The hand fin apparatus of claim 16, wherein the handle portion is sized to allow water to pass through the handle portion to redirect water flow passing over the hand fin apparatus, during use.

19. The hand fin apparatus of claim 16, wherein an auxiliary handle pad is selectively attachable to the handle portion of the hand fin apparatus, to increase a grip size on the handle portion, and to improve control of the hand fin apparatus during use; the auxiliary handle pad releasably secured to the handle portion with at least one strap, and the at least one strap provides an auxiliary attachment means for auxiliary gear used in conjunction with the hand fin apparatus.

20. The hand fin apparatus of claim 16, wherein a focusing raceway is formed between the main body portion and the trailing edge of the hand fin apparatus, the focusing raceway tapering in thickness toward the center of the hand fin apparatus and towards the trailing edge of the hand fin apparatus to direct and funnel water flow passing over the hand fin apparatus, to generate lift during use.

21. A hand fin apparatus of claim 16, wherein the hand fin apparatus is inflatable, and an inflation valve is provided to selectively inflate and deflate the hand fin apparatus, and the hand fin apparatus is buoyant when inflated, and compressible to a small size when deflated, for ease of transport and storage.

22. The hand fin apparatus of claim 16, wherein the hand fin apparatus includes a hollow portion forming an internal chamber therein, and a first plug tip is releasably secured to a first aperture located in proximity to the first trailing point, the first aperture in fluid communication with the internal chamber, and a second plug tip is releasably secured to a second aperture provided in proximity to the second trailing point, the second aperture in fluid communication with the internal chamber, and the first and second plug tips are removed from the first and second trailing points to selectively fill the hollow hand fin apparatus with water, and the first and second plug tips are subsequently releasably secured to the respective first and second apertures when the hollow portion of the hand fin apparatus is filled to a desired weight with water prior to use; and wherein the water is removed after use, to reduce the weight of the hand fin apparatus, for ease of transport and storage.

23. The hand fin apparatus of claim 16, wherein an elongated wrist strap is attachable to the handle portion of the hand fin apparatus, and an aperture is provided near one end of the wrist strap to receive a second end of the wrist strap therethrough, and the wrist strap is sized to engage the handle portion of the hand fin, with one end extending to be wrapped about a user's wrist and secured thereto, to releasably secure the hand fin apparatus to the user's wrist, for improved control of the hand fin apparatus, during use.

24. A hand fin apparatus, comprising:

an aerodynamic hand fin apparatus with a substantially symmetrical fish tail shape, the hand fin apparatus with a curved leading edge having a first thickness; a curved trailing edge positioned in spaced relation from the curved leading edge, the leading edge and the trailing edge joined at opposing first and second trailing points, the hand fin apparatus with a trailing edge having a second thickness, narrower in thickness than the first thickness located at the leading edge of the swim fin apparatus, the main body portion includes a third thickness that is thicker than the first thickness located at the leading edge, and the third thickness tapers towards the second thickness located at the trailing edge of the hand fin apparatus;

a main body portion extends between the leading edge and the trailing edge, the main body portion shaped such that water flowing over the main body portion is guided toward a centerline of the hand fin apparatus and toward the trailing edge of the hand fin apparatus; and an elongated handle portion positioned across the centerline of the hand fin apparatus, the elongated handle portion positioned between the leading edge and the trailing edge of the hand fin apparatus, the handle portion sized to receive a user's hand therethrough, the handle portion further sized to allow water to pass through the handle portion to redirect water flow passing over the hand fin apparatus, during use; and a focusing raceway formed along the main body portion of the hand fin apparatus, the focusing raceway tapering in thickness toward the trailing edge of the hand fin apparatus to direct and funnel water flow passing over the hand fin apparatus towards the centerline of the hand fin apparatus, and to generate lift during use.

25. A hand fin apparatus, comprising:

a) an aerodynamic hand fin apparatus with a substantially symmetrical fish tail shape, the hand fin apparatus with a first cast material forming a curved leading edge portion having a first thickness;

b) a second cast material forming a main body portion positioned in spaced relation from the curved leading edge, the second cast material selected to be less rigid than the first cast material, the main body portion being shaped such that water flowing over the main body portion is guided toward a centerline of the hand fin apparatus; and c) a flexible, curved trailing edge portion secured to the second cast material, the curved trailing edge positioned in spaced relation from the main body portion, the trailing edge portion with a second thickness, narrower in thickness than the first thickness, the trailing edge is flexible to generate lift as the hand fin apparatus is moved through water;

d) the leading edge and the trailing edge joined at opposing first and second trailing points; and e) a handle portion positioned between the leading edge and the trailing edge of the hand fin apparatus, the handle portion sized to receive a user's hand therethrough, and the handle portion is sized to allow water to pass through the handle portion to redirect water flow passing over the hand fin apparatus, during use.

26. The hand fin apparatus of claim 25, wherein an auxiliary handle pad is selectively attachable to the handle portion of the hand fin apparatus, to increase a grip size on the handle portion, and to improve control of the hand fin apparatus during use; the auxiliary handle pad releasably secured to the handle portion with at least one strap, and the at least one strap provides an auxiliary attachment means for auxiliary gear used in conjunction with the hand fin apparatus.

27. The hand fin apparatus of claim 25, wherein a focusing raceway is formed between the main body portion and the trailing edge of the hand fin apparatus, the focusing raceway tapering in thickness toward the centerline of the hand fin apparatus and towards the trailing edge of the hand fin apparatus to direct and funnel water flow passing over the hand fin apparatus, and to generate lift during use.

28. The hand fin apparatus of claim 25, wherein the hand fin apparatus includes a hollow portion forming an internal chamber therein, and a first plug tip is releasably secured to a first aperture located in proximity to the first trailing point, the first aperture in fluid communication with the internal chamber, and a second plug tip is releasably secured to a second aperture provided in proximity to the second trailing point, the second aperture in fluid communication with the internal chamber, and the first and second plug tips are removed from the first and second trailing points to selectively fill the hollow hand fin apparatus with water, and the first and second plug tips are subsequently releasably secured to the respective first and second apertures when the hollow portion of the hand fin apparatus is filled to a desired weight with water prior to use; and wherein the water is removed after use, to reduce the weight of the hand fin apparatus, for ease of transport and storage.

29. The hand fin apparatus of claim 25, wherein an elongated wrist strap is attachable to the handle portion of the hand fin apparatus, and an aperture is provided near one end of the wrist strap to receive a second end of the wrist strap therethrough, and the wrist strap is sized to engage the handle portion of the hand fin, with one end extending to be wrapped about a user's wrist and secured thereto, to releasably secure the hand fin apparatus to the users wrist during use, for improved control of the hand fin apparatus, during use.

30. A hand fin apparatus comprising:

a) an aerodynamic hand fin apparatus with a main body portion, a curved leading edge, a curved trailing edge positioned in spaced relation from the curved leading edge, the leading edge and the trailing edge joined at opposing first and second trailing points, the main body portion of the hand fin having a top side and a bottom side;

b) a handle aperture extending at least partially through the main body portion of the hand fin apparatus, the handle aperture sized to receive a user's fingers at least partially therein, the handle aperture positioned between the leading edge, the trailing edge, and the opposing first and second trailing points of the main body portion;

c) a flexible top flap secured to the top side of the main body portion of the hand fin in proximity to the leading edge, and sized to at least partially cover the top side of the handle aperture;

d) a flexible bottom flap secured to the bottom side of the main body portion of the hand fin in proximity to the leading edge, and sized to at least partially cover the bottom side of the handle aperture.

31. The hand fin apparatus of claim 30, wherein the trailing edge of the hand fin is flexible to generate lift as the hand fin apparatus is moved through the water.

32. The hand fin apparatus of claim 30, wherein the main body portion includes a focusing raceway formed along the center portion of the hand fin apparatus, the focusing raceway defined by the main body portion tapering in thickness toward the center portion of the hand fin apparatus between the leading edge and the trailing edge, to direct and funnel water flow passing over the hand fin apparatus to generate lift during use.

33. The hand fin apparatus of claim 30, wherein the main body portion tapers towards the trailing edge and includes a self regulating pitch selected to be between fifteen degrees and twenty degrees when the hand fin apparatus is selectively pushed and pulled in water.

34. The hand fin apparatus of claim 30, wherein a protrusion extends within the handle aperture in spaced relation from the leading edge, to provide a finger ledge to aid in the manipulation and control of the hand fin apparatus when selectively pushed and pulled through water.

35. The hand fin apparatus of claim 30, wherein a recess extends within the handle aperture adjacent to the leading edge, to provide a finger recess to aid in the manipulation and control of the hand fin apparatus when selectively pushed and pulled through water.

36. The hand fin apparatus of claim 30, wherein the top flap and the bottom flap are joined along the leading edge of the hand fin apparatus, and opposing notches are provided along the leading edge to aid in releasably securing the top flap and the bottom flap to the leading edge of the main body portion of the hand fin apparatus.

37. The hand fin apparatus of claim 30, wherein at least one notch is provided along the trailing edge of the top flap and the bottom flap to aid in placement of the user's hand through the handle portion of the main body portion of the hand fin apparatus, beneath one of the top flap and the bottom flap, during use.

38. A hand fin apparatus comprising:

a) an aerodynamic hand fin apparatus with a main body portion, a curved leading edge, a curved trailing edge positioned in spaced relation from the curved leading edge, the leading edge and the trailing edge joined at opposing first and second trailing points, the main body portion of the hand fin having a top side and a bottom side forming an air tight chamber there between;

b) a handle aperture extending at least partially through the main body portion of the hand fin apparatus, the handle aperture sized to receive a users fingers at least partially therein, the handle aperture positioned between the leading edge, the trailing edge, and the opposing first and second trailing points of the main body portion without affecting the integrity of the air tight chamber;

c) the opposing trailing points each having an air valve aperture extending through at least one of the top side and the bottom side;

d) the opposing air valve apertures each having a removable and replaceable valve cap for selective insertion of air and liquid within the air tight chamber, the liquid serving as a ballast and the air serving as a buoyant fluid, enabling the user to selectively control the buoyancy of the hand fin apparatus.

39. The hand fin apparatus of claim 38, wherein the hand fin apparatus is symmetrical and aerodynamic in shape.

40. The hand fin apparatus of claim 38, wherein the hand fin apparatus is asymmetrical and aerodynamic in shape.

41. The hand fin apparatus of claim 38, wherein the trailing edge is flexible to generate lift as the hand fin apparatus is moved through water.

42. The hand fin apparatus of claim 38, wherein a focusing raceway is formed between the main body portion and the trailing edge of the hand fin apparatus, the focusing raceway tapering in thickness toward the center of the hand fin apparatus and towards the trailing edge of the hand fin apparatus to direct and funnel water flow passing over the external surface of the hand fin apparatus to generate left during use.

* * * * *